US005672130A

United States Patent [19]

O'Connell et al.

[11] Patent Number: 5,672,130

[45] Date of Patent: Sep. 30, 1997

[54] BASKETBALL GOAL

[75] Inventors: Timothy P. O'Connell, East Aurora; Mark A. Strayer, Orchard Park, both of N.Y.

[73] Assignee: Fisher-Price, Inc., East Aurora, N.Y.

[21] Appl. No.: 698,369

[22] Filed: Aug. 15, 1996

[51] Int. Cl.[6] ..... A63B 63/08

[52] U.S. Cl. ..... 473/483; 473/489

[58] Field of Search ..... 473/479–489

[56] References Cited

U.S. PATENT DOCUMENTS

| | | | |
|---|---|---|---|
| Re. 20,898 | 10/1938 | Schabinger | 273/1.5 |
| D. 315,185 | 3/1991 | Maloney | D21/201 |
| D. 320,637 | 10/1991 | Fish, Jr. et al. | D21/201 |
| 1,544,453 | 6/1925 | Harbison | 473/489 |
| 2,489,174 | 11/1949 | Cunningham | 273/1.5 |
| 2,512,417 | 6/1950 | Cook | 248/315 |
| 2,666,641 | 1/1954 | Bonham | 273/1.5 |
| 2,735,680 | 2/1956 | Ross | 273/1.5 |
| 2,884,249 | 4/1959 | Cunningham | 273/1.5 |
| 3,194,555 | 7/1965 | Humphrey | 273/1.5 |
| 3,716,234 | 2/1973 | Lancellotti | 273/1.5 R |
| 4,071,238 | 1/1978 | Chapman | 273/1.5 R |
| 4,082,269 | 4/1978 | Hill | 273/1.5 R |
| 4,145,044 | 3/1979 | Wilson et al. | 273/1.5 R |
| 4,241,916 | 12/1980 | Palm | 273/1.5 R |
| 4,468,027 | 8/1984 | Pangburn | 273/1.5 R |
| 4,522,394 | 6/1985 | Broussard | 273/1.5 R |
| 4,715,600 | 12/1987 | Offutt | 273/1.5 R |
| 4,793,611 | 12/1988 | Thornell | 273/1.5 R |
| 4,805,903 | 2/1989 | McArdle | 273/1.5 R |
| 4,887,812 | 12/1989 | Moormann | 273/1.5 R |
| 4,903,964 | 2/1990 | Anderson | 273/1.5 R |
| 4,905,995 | 3/1990 | Apo | 273/1.5 R |
| 4,974,841 | 12/1990 | Jarriel et al. | 273/1.5 R |
| 5,082,261 | 1/1992 | Pelfrey | 273/1.5 R |
| 5,112,023 | 5/1992 | Sowers | 248/519 |
| 5,154,414 | 10/1992 | Auer et al. | 273/1.5 R |
| 5,158,281 | 10/1992 | Williams | 273/1.5 R |
| 5,163,676 | 11/1992 | Taub | 473/483 |
| 5,207,407 | 5/1993 | Fitzsimmons et al. | 248/519 |
| 5,207,419 | 5/1993 | Schroeder | 473/481 |
| 5,248,140 | 9/1993 | Matherne et al. | 273/1.5 R |
| 5,259,612 | 11/1993 | Matherne et al. | 273/1.5 R |
| 5,354,049 | 10/1994 | Matherne et al. | 273/1.5 R |
| 5,360,208 | 11/1994 | Fang | 473/489 |
| 5,375,835 | 12/1994 | Van Nimwegen et al. | 273/1.5 R |
| 5,377,976 | 1/1995 | Matherne et al. | 273/1.5 R |
| 5,393,048 | 2/1995 | Rodriguez-Ferre | 473/483 |
| 5,415,393 | 5/1995 | Fitzsimmons et al. | 273/1.5 R |

FOREIGN PATENT DOCUMENTS

WO 94/17866 8/1994 WIPO .

OTHER PUBLICATIONS

"Today's Kids" Advertising Circular.
Huffy International Advertising Circular.

*Primary Examiner*—Paul E. Shapiro
*Attorney, Agent, or Firm*—Morgan, Lewis and Bockius, LLP; C. Scott Talbot

[57] ABSTRACT

A basketball system having has a ballasted base, an adjustable support system comprising two pole sections, a backboard, a hoop structure, and a net. They include an upper pole section and a lower pole section, and may be operated either telescopically or non-telescopically. The base has a first socket that receives the lower pole section, and a second socket is sized to receive the upper pole section when the system is operated in the non-telescoping mode. The hoop structure is provided with a neck flange for attaching the hoop structure to a recess in the upper telescoping pole section. The net is attached to the hoop structure by a net retention hoop on which the net is threadedly engaged.

11 Claims, 25 Drawing Sheets

BASKETBALL GOAL

BACKGROUND OF THE INVENTION

This invention relates generally to toy basketball goal systems, and more particularly to a consumer-assemblable basketball goal system suitable for use by children in a wide range of ages. The toy basketball goal system of the present invention is sold to the user disassembled. It may be easily and quickly assembled, with simple tools, by the end user in a matter of minutes.

Numerous toy basketball goal systems are currently available for home use. Many such systems merely provide a hoop or hoop-and-backboard structure attached to a wall or door frame. Others include a support pole or like structure to provide support for the hoop and the backboard. These systems typically comprise a support base, a pole for supporting the hoop and adjusting its height, a backboard, the hoop, and a net. Some such systems allow the base to be filled with ballast, such as sand or water, to stabilize the base during use.

The systems involving a support structure must provide some means of connecting the hoop to the support post structure. Generally, the hoop structure is provided with a neck flange extending radially from the hoop and in the same plane. The remote end of the flange usually includes a ring or cap fitting over the top of the support post for securing the hoop to the support post. U.S. Pat. No. 4,145,044 provides a toy basketball goal system having a base, a telescoping support pole, and a hoop structure with a neck flange extending radially from the periphery of the hoop. The neck flange includes a cap, which fits over the top of a telescoping support pole, and a downwardly projecting tube fitting closely inside the inner surface of the support tube. The backboard is provided with a notch which fits into a vertical slot in the neck flange. In this system, the support pole provides no support or stabilization for the backboard. Lateral movement of the hoop and backboard is inhibited by the friction fit between the downwardly projecting tube and the inside surface of the support post.

U.S. Pat. No. 5,082,261 is another system involving a base and telescoping support pole for the backboard and hoop. The hoop structure includes a neck flange extending from the periphery of the hoop. The neck flange is provided with a square opening perpendicular to the plane of the flange. The hoop structure is attached to the support pole by fitting the square opening in the hoop flange over the top of the upper support pole and sliding the hoop structure down the shaft of the support pole a short distance. Upper and lower detent structures hold the hoop structure in position relative to the upper support pole. The fit of the square opening of the hoop flange against the periphery of the square cross section of the support pole inhibits lateral movement of the hoop structure. The backboard includes an aperture for slidable engagement with the neck flange. The backboard is supported by the neck flange and by the abutment of its back surface against the forward surface of the support pole.

A toy basketball system sold by Ohio Arts Company under the name "Shaq Attaq" has a base and an adjustable support pole. The hoop is provided with a radially extending flange which has a square opening in the plane thereof. The square opening fits over the top of the support post and annually engages its periphery. Inwardly facing detent buttons near the forwardmost edge of the square opening provide a pivot axis for "breakaway" action of the rim when excessive force is applied to the hoop structure. The fit of the square opening of the hoop flange against the square cross section of the support post inhibits lateral movement of the hoop structure. The backboard is provided with a U-shaped cut in its lower edge which is fitted over the U-shaped top of the support pole.

The prior art systems all suffer from a limited range of adjustable heights. Most of the adjustable prior art systems use a telescoping support pole system having a single mode of operation. The height of these systems will be limited by the length of the longer pole of the telescoping pole system. This prevents the system from being used, in particular, by very young children who cannot project a basketball into the hoop at even the lowermost height settings. The limited range of adjustable heights may require multiple systems to be purchased as the child grows toward maturity, or may prevent simultaneous use of the system by children of widely varying ages. The length of the telescoping pole system may be adjusted by either a simple pin-and-hole system or a latch system with detents at the various heights. Another type of adjustable height toy basketball system operates by sliding a backboard and hoop assembly down the shaft of a fixed pole. This apparatus lacks the durability of telescoping pole type systems, and becomes progressively more aesthetically objectionable as the backboard and hoop are lowered because of the visibility of the upper part of the support pole extending above the backboard.

In addition, the prior art systems generally provide relatively poor performance in retaining the net securely in place. Typically, the net is retained by lug structures on the inner surface of the hoop, on which the upper loops of the net art threaded. The loops frequently become disengaged from the support lugs, requiring additional time to rethread the loops on the support lugs and presenting a safety concern with entanglement of a user's fingers, hands, or other body parts in the gap formed by the detached loop.

SUMMARY

These shortcomings of known basketball systems are overcome by the system of the present invention. This system has a ballasted base and an adjustable support system comprising two pole sections. The pole sections may be operated in either telescoping or non-telescoping modes, and include an upper pole section and a lower pole section. When the system is operated in the telescoping mode the upper pole section fits telescopically into the lower pole section.

The base has a first socket that receives the lower pole section, and a second socket is sized to receive the upper pole section when the system is operated in the non-telescoping mode. The upper pole section can be either slidably adjusted to varying heights within the lower telescoping pole section or fitted into the second support socket in the base, allowing a greater range of adjustable heights for the system. A backboard, a hoop structure, and a net with a retainer are also provided.

The hoop structure is provided with a neck flange for attaching the hoop structure to the upper pole section. The hoop structure is attached directly to a coordinating hoop support recess in the upper pole section. Both the neck of the hoop flange structure and the hoop support recess are contoured to provide a snap fit of the hoop flange into the recess, thereby providing a suitably rigid support while minimizing the size and cost of the hoop flange.

Detent posts on the outside edges of the hoop flange provide a pivot axis for mounting the backboard. Two journal indentations in the backboard engage the detent posts on the outside edges of the hoop flange. The backboard is then pivoted from behind the upper pole section into position flush with a front face of the support post. Detent lugs on the support post, along with the pivot detent posts on the edges of the hoop flange, hold the backboard securely in position. The system of the present invention provides a unique way of integrally combining the hoop structure, the support post, and the backboard to create a very stable basketball goal structure.

The hoop structure is provided with an inner flange on the inside surface of the hoop. A net retention hoop, on which the net loops are threaded, may be permanently and securely attached to the inner flange of the hoop to prevent the net from becoming detached from the hoop structure.

DETAILED DESCRIPTION

Figure 1A:
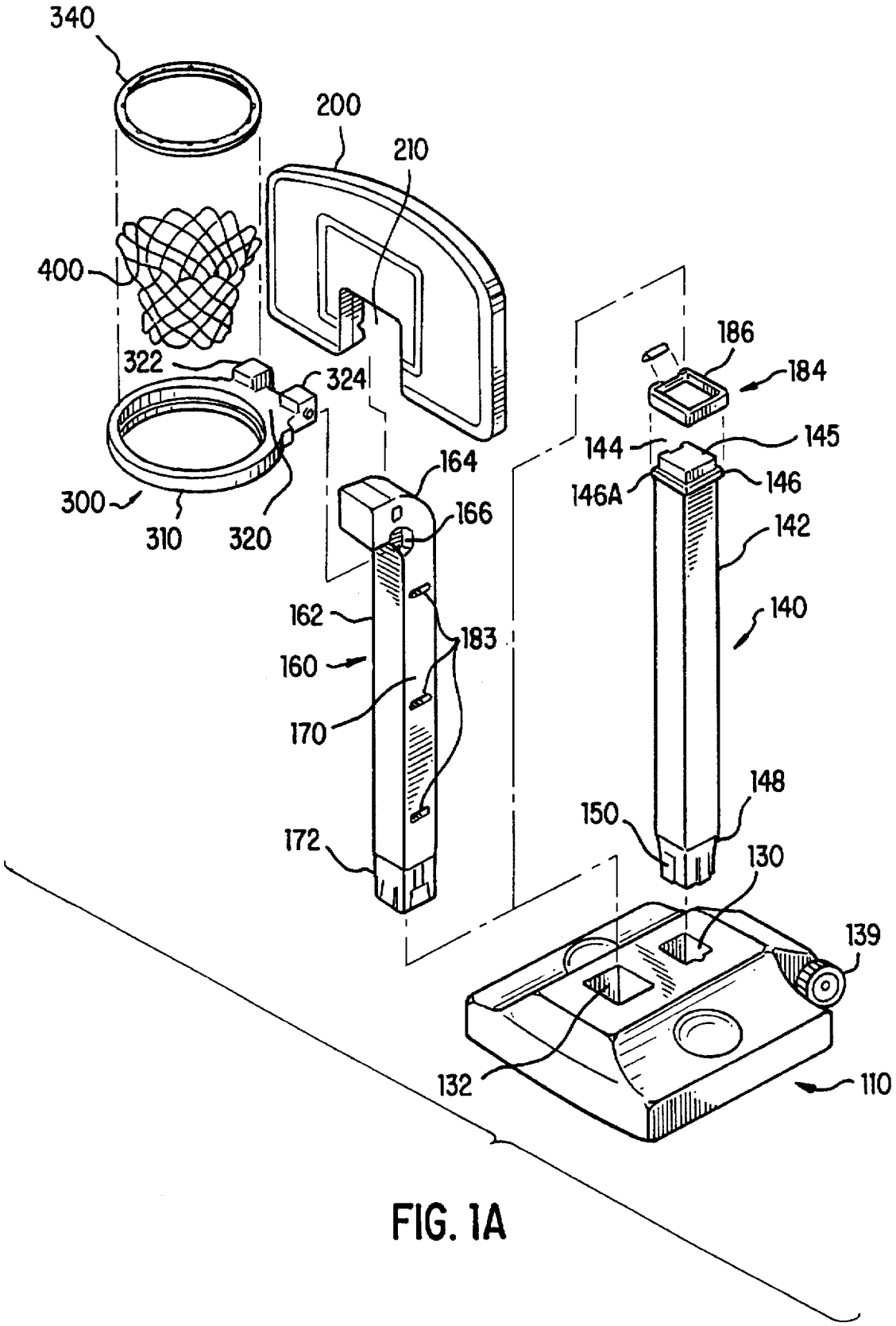
FIGS. 1A–C are exploded, front and rear assembled views, respectively, of a basketball goal embodying the principles of the present invention.
Figure 1C:
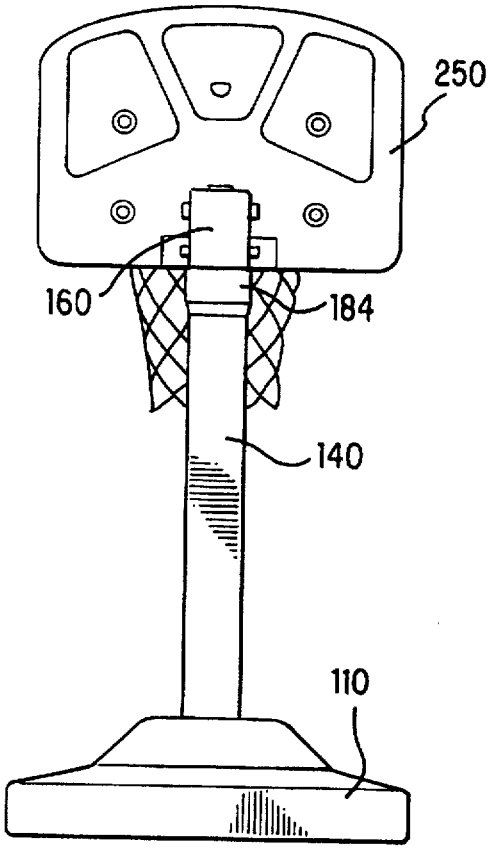
Figure 1B:
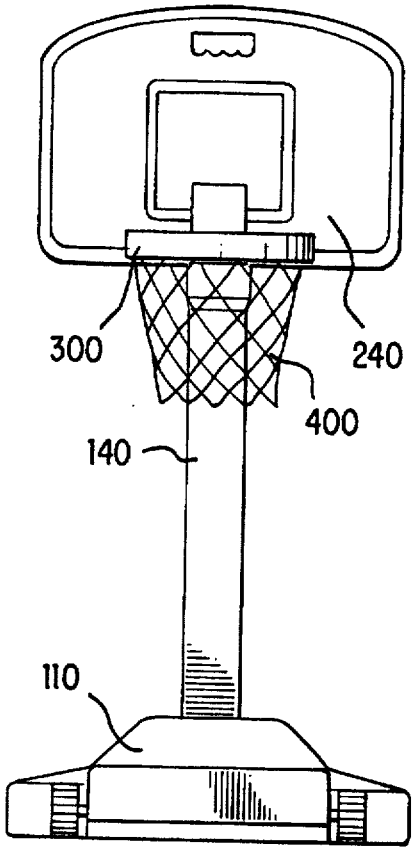

A basketball goal embodying the principles of the invention is shown in FIG. 1A as an exploded assembly. Basketball goal system 50 includes a support system 100, a backboard 200, a hoop structure 300, a circular net retention hoop 340, and a net 400. The support system 100 comprises a base assembly 110, a lower pole section 140, an upper pole section 160, and a latch assembly 184. Base assembly 110 comprises a hollow molded plastic base 111, and a wheel assembly 139.

Base

Figure 2A:
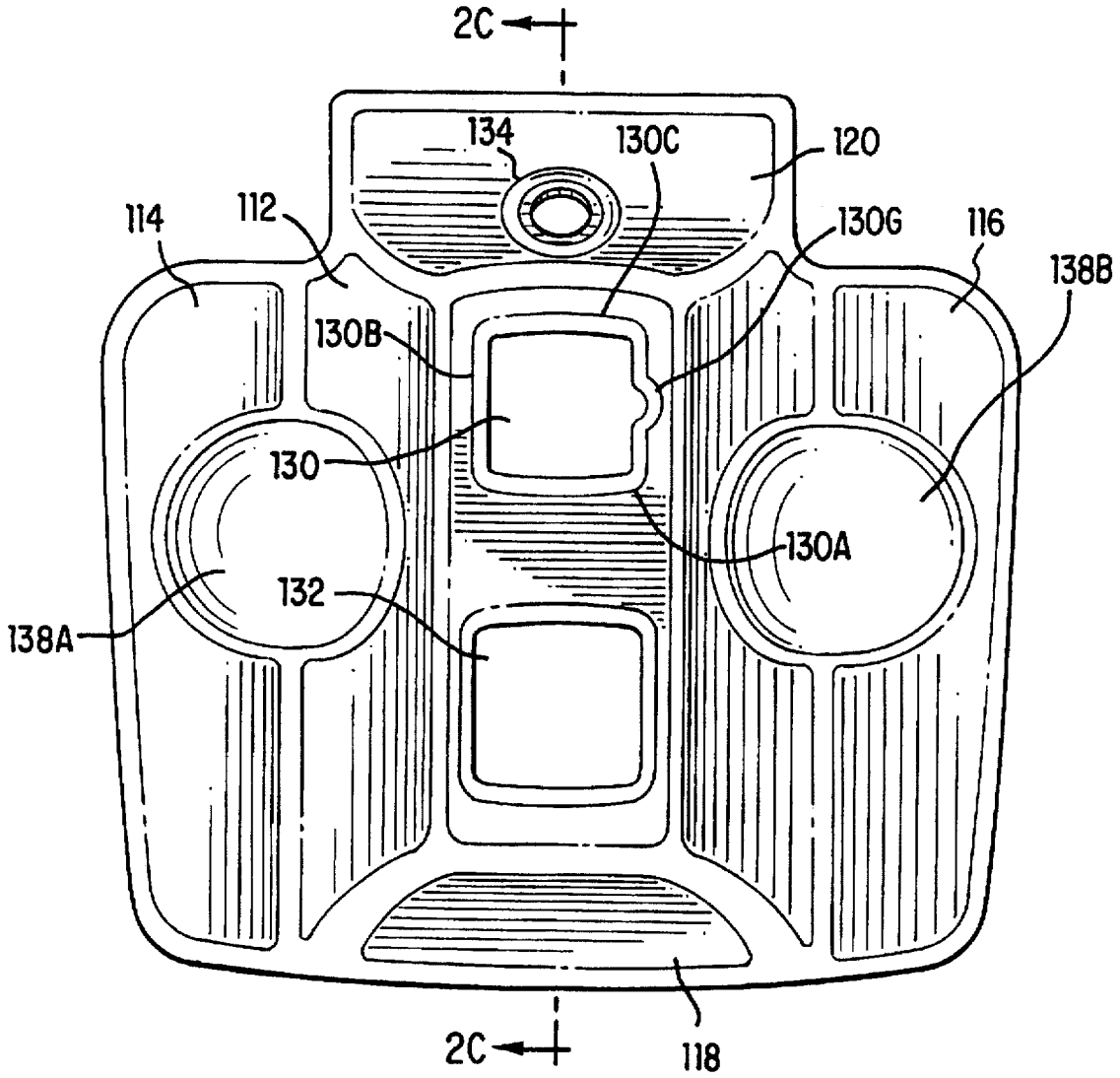
FIGS. 2A and 2B are top and rear perspective views, respectively, of the base of the basketball goal of FIG. 1A.

Referring more particularly to FIG. 2A, the base 111 has a contoured upper surface 112 which includes left and right concave side recesses 114 and 116 and wedge-shaped front and back surfaces 118 and 120. The base 111 is provided with a lower pole socket 130 having a square cross-section for receiving the lower pole section 140. An upper pole socket 132, also having a square cross-section, is sized to receive the upper pole section 160 when the system is operated in the non-telescoping mode. Left and right ball recesses 138A and 138B are provided to retain a basketball in the base 111. An aperture 134 which communicates with the interior of the base 111 allows it to be filled with a ballast such as sand or water. A plug (not shown) may be inserted into the aperture 134 to retain the ballast.

Figure 2B:
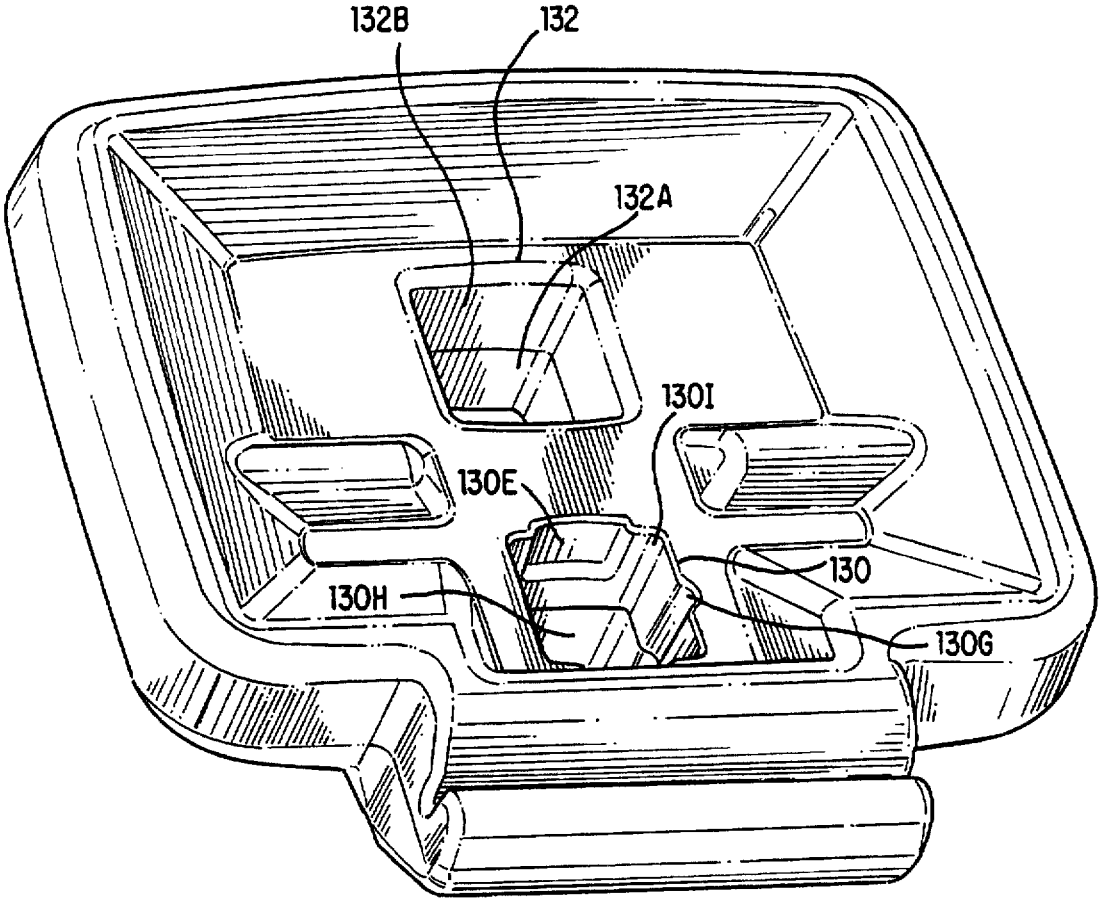
Figure 2C:
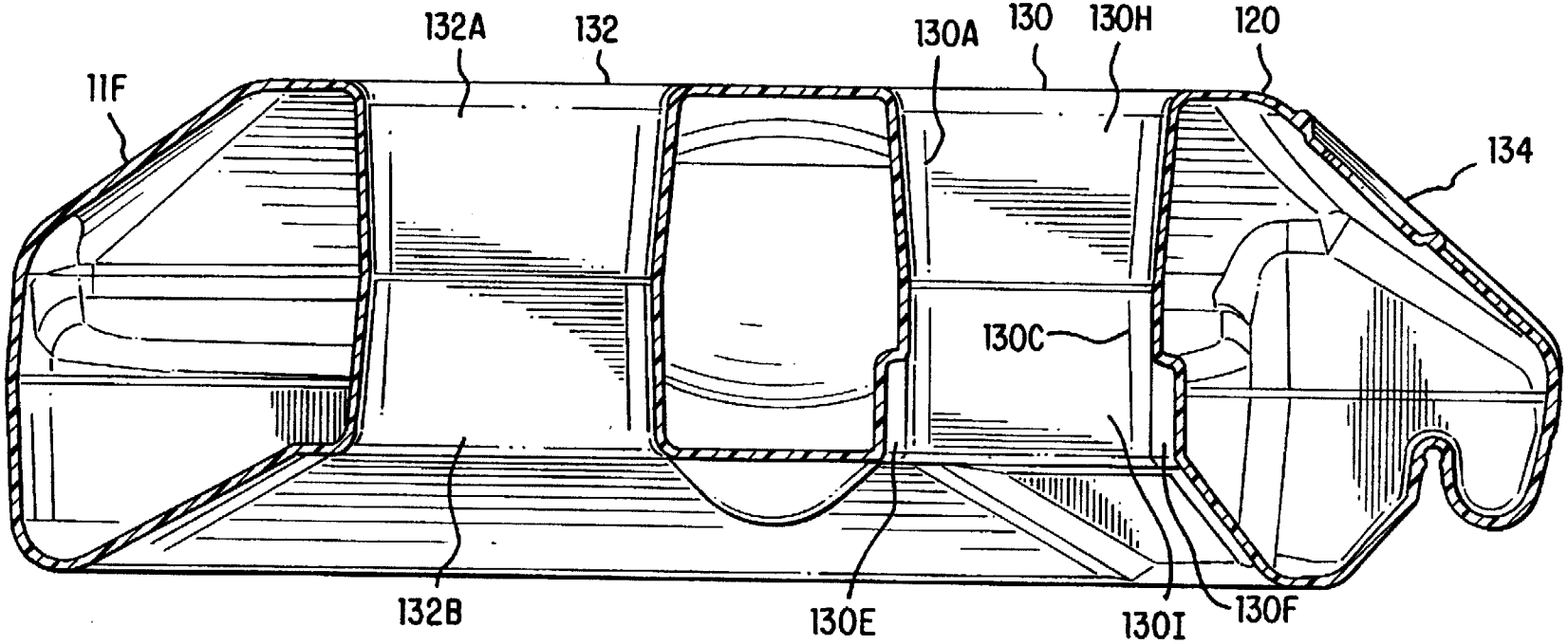
FIG. 2C is a cross-sectional view of the base taken along section 2C—2C of FIG. 2A FIGS. 3A and 3B are front and right side views of the lower end of the lower pole section of the basketball goal of FIG. 1A.

The upper and lower pole sockets 132 and 130 are shown in greater detail in FIGS. 2B and 2C. The front wall and rear walls 130A and 130C of the lower pole socket 130 are provided with front and rear detent recesses 130E and 130F, respectively, to securely retain the lower pole 140. A keyhole slot 130G is provided in right wall 130D to align with a key 153 on the lower pole section 140 to ensure that the lower pole section is properly oriented in the base 111. The lower pole socket 130 is provided with an upper portion 130H and a lower portion 130I which taper slightly to a reduced cross-sectional area in the center of the socket. Upper pole socket 132 is similarly provided with an upper portion 132A and a lower portion 132B which likewise taper to a reduced cross-sectional area in the center of the socket.

Lower Pole Section

Figure 3B:
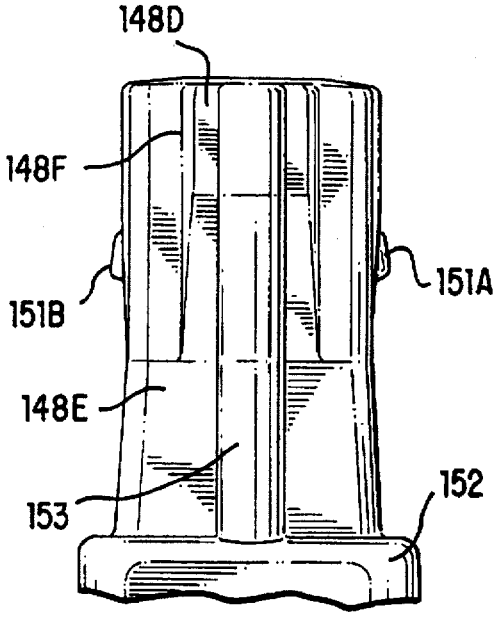
FIG. 3C is a perspective view of the lower pole section.
Figure 3A:
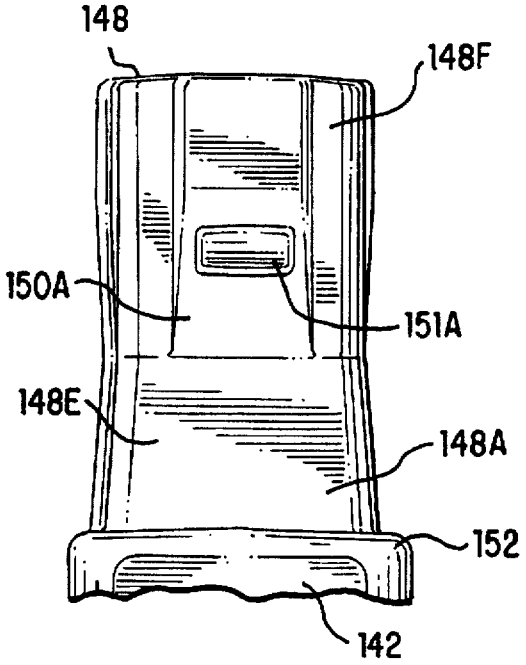
Figure 3C:
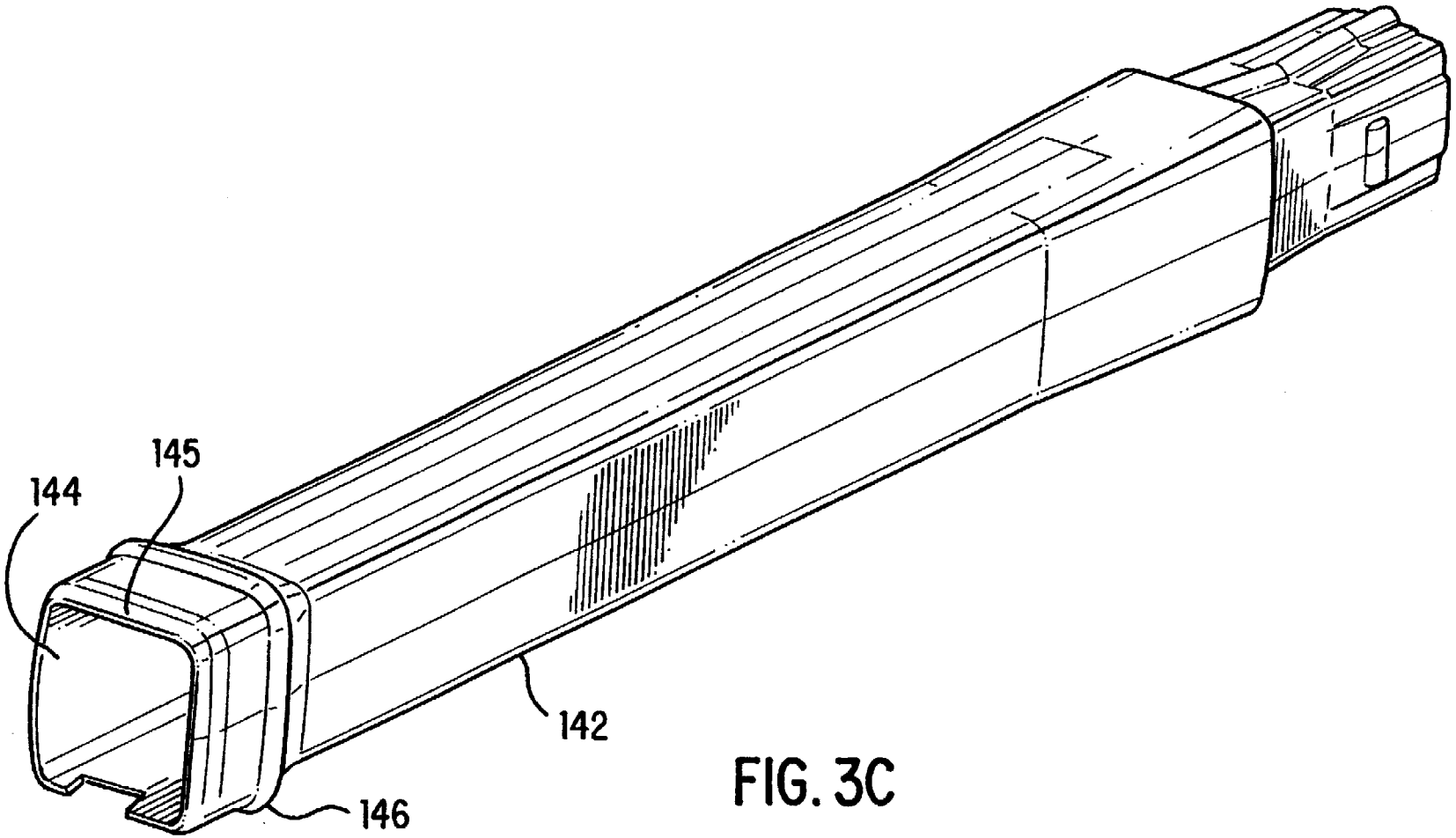

FIG. 1A depicts a lower pole section 140 having a shaft 142 and an axial bore 144 with an upper opening 145. An upper collar region 146 is provided with a peripheral shoulder 146A for engaging the collar assembly 184, and a lower end 148 is provided with a reduced cross section for engaging the first socket 130. As shown in greater detail in FIGS. 3A, 3B, and 3C, the lower end 148 of the lower pole section 140 has tapered upper and lower portions 148E and 148F for engaging the tapered upper and lower portions 130H and 130I of the lower socket 130 in the base 111. The lower end 148 of the lower pole section 140 has front and rear walls 148A and 148C, and left and right walls 148B and 148D. The lower portion of each wall is provided with a wedge shaped portion (150A–D) for engaging the four walls of the lower pole socket 130.

Again referring to FIGS. 3A, 3B, and 3C, the front wedge 150A and the rear wedge 150C of the lower end 148 of the lower pole section 140 are provided with front and rear detents 151A and 151B, which engage the front and rear detent recesses 130E and 130F of lower pole socket 130 to provide a secure fit of the lower pole section 140 in the base 111. Proper orientation for the lower pole 140 in the base 111 is ensured by a vertical keyhole slot 153 in the right wall 148D of the lower end 148. A peripheral shoulder 152 separating the lower end 148 from the shaft 142 provides an abutment surface for the lower pole section 140 with the contoured upper surface 112 of the base 111.

Latch Assembly

A latch assembly 184 is provided to facilitate the telescoping engagement of the upper pole section 160 with the lower pole section 140. The latch assembly 184 comprises a latching collar 186 having a center opening 188 for slidably receiving the upper pole section 160 there through. A pivot latch 190 is provided to engage one of the molded detents 183 of the upper pole section 160. Latching collar 186 is adapted to engage the upper collar region 146 of the lower pole section 140. The construction and operation of the latch assembly are substantially similar to that disclosed in U.S. Pat. No. 5,082,261, the disclosure of which is hereby incorporated by reference.

Upper Pole Section

As shown in FIG. 1A, upper pole section 160 has a shaft 162, a curved upper end 164, a hoop support recess 166, a plurality of molded detents 183 along a side 170, and a lower end 172. As shown in greater detail in FIGS. 4A, 4B, and 4C, the lower end 172 of the upper pole section 160 comprises an upper portion 173A and a lower portion 173B. The cross-sections of the upper and lower portions narrow to a reduced cross-sectional area in the center of the lower end for engaging the tapered upper and lower portions 132A and 132B of the lower socket 132 in the base 111. The sides of the lower end 172 are provided with contoured surfaces to ensure a firm engagement with the sides of the lower socket 132. The front and rear sides of the lower end 172 are provided with front and rear wedges 174A and 174B, respectively. The left and right sides of the lower end 172 have left and right grooves 175A and 175B, respectively.

Figure 4A:
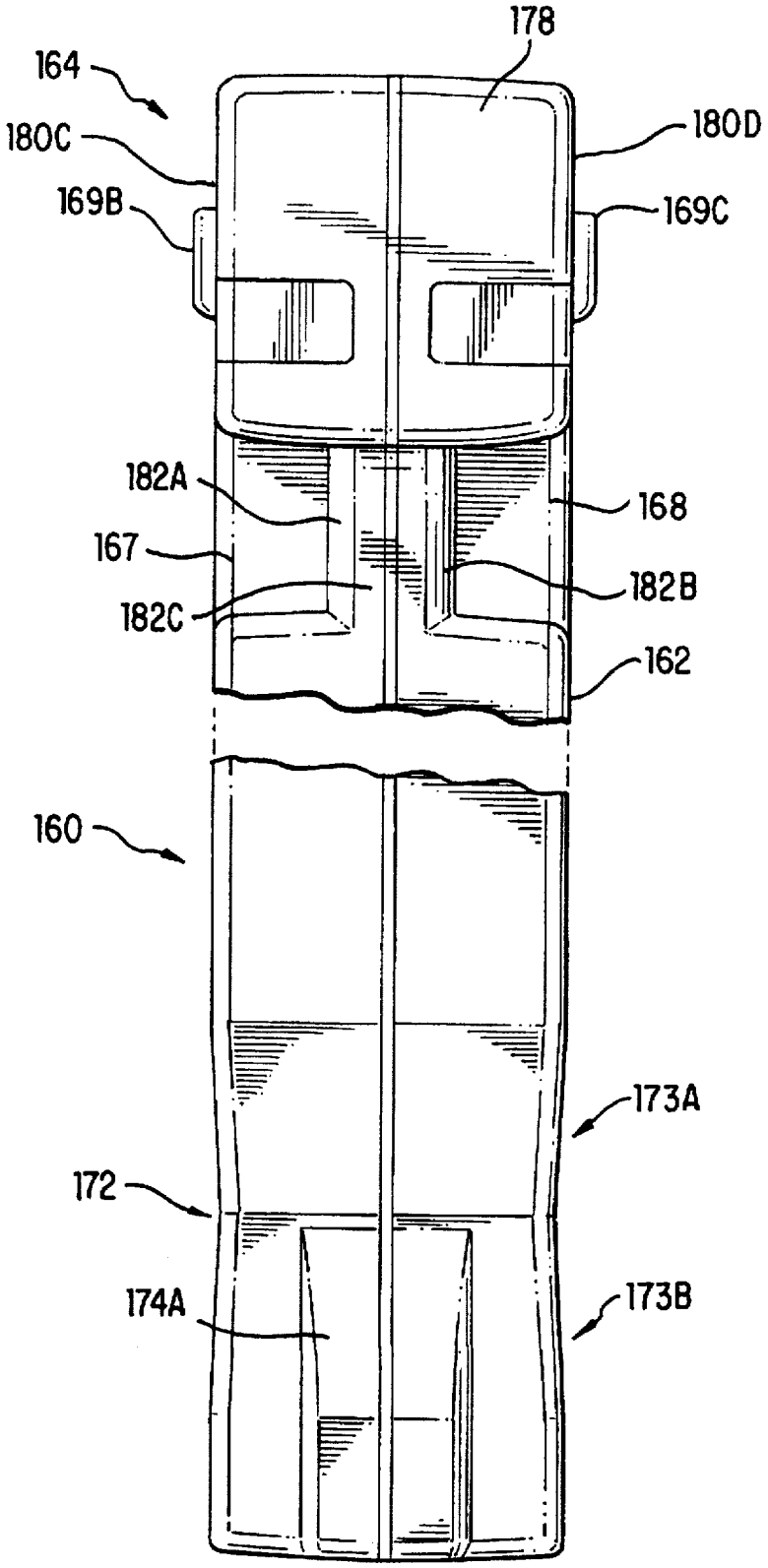
FIGS. 4A–C are partial front and side views, and a top view, respectively, of the upper pole section.
Figure 4B:
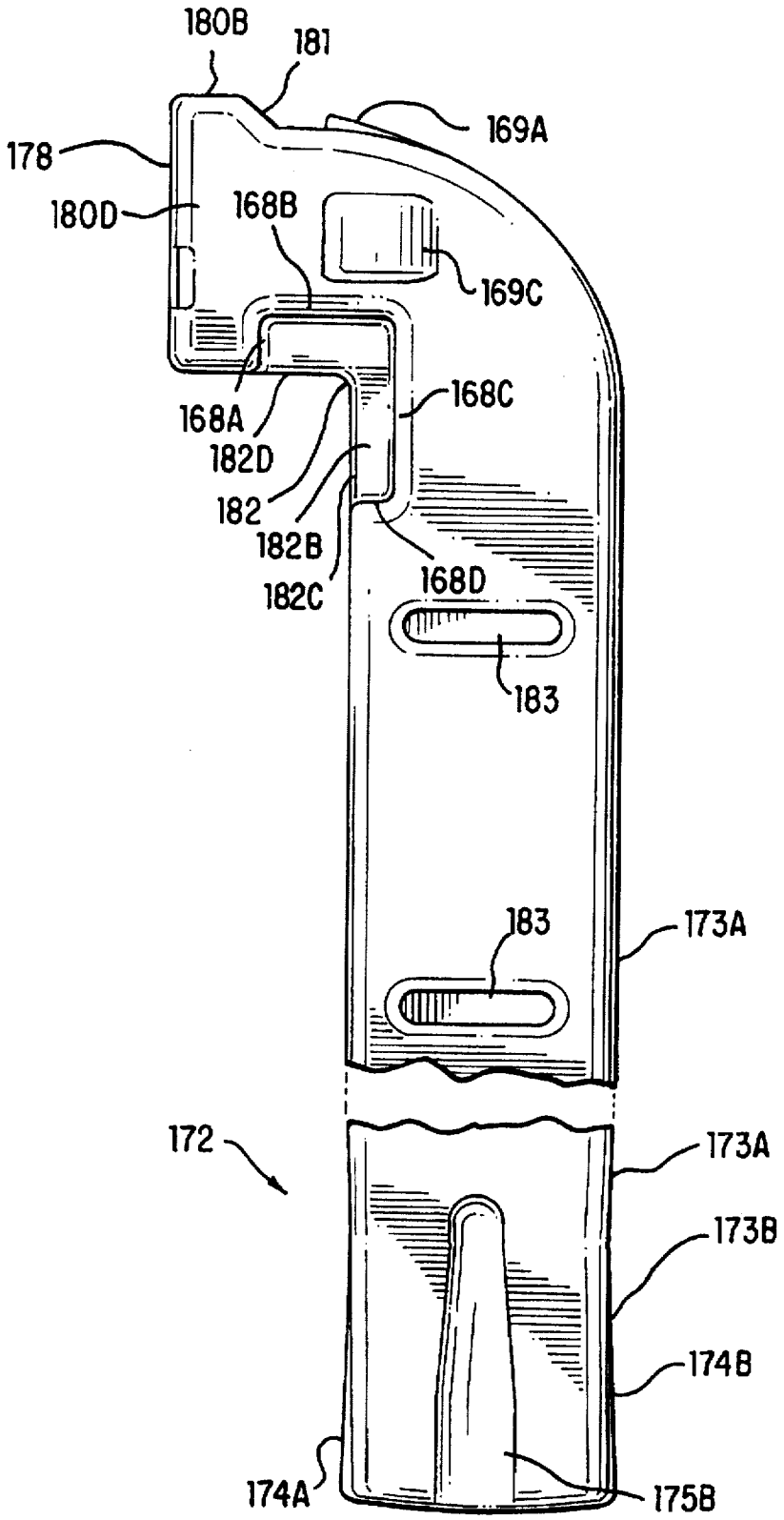
Figure 4C:
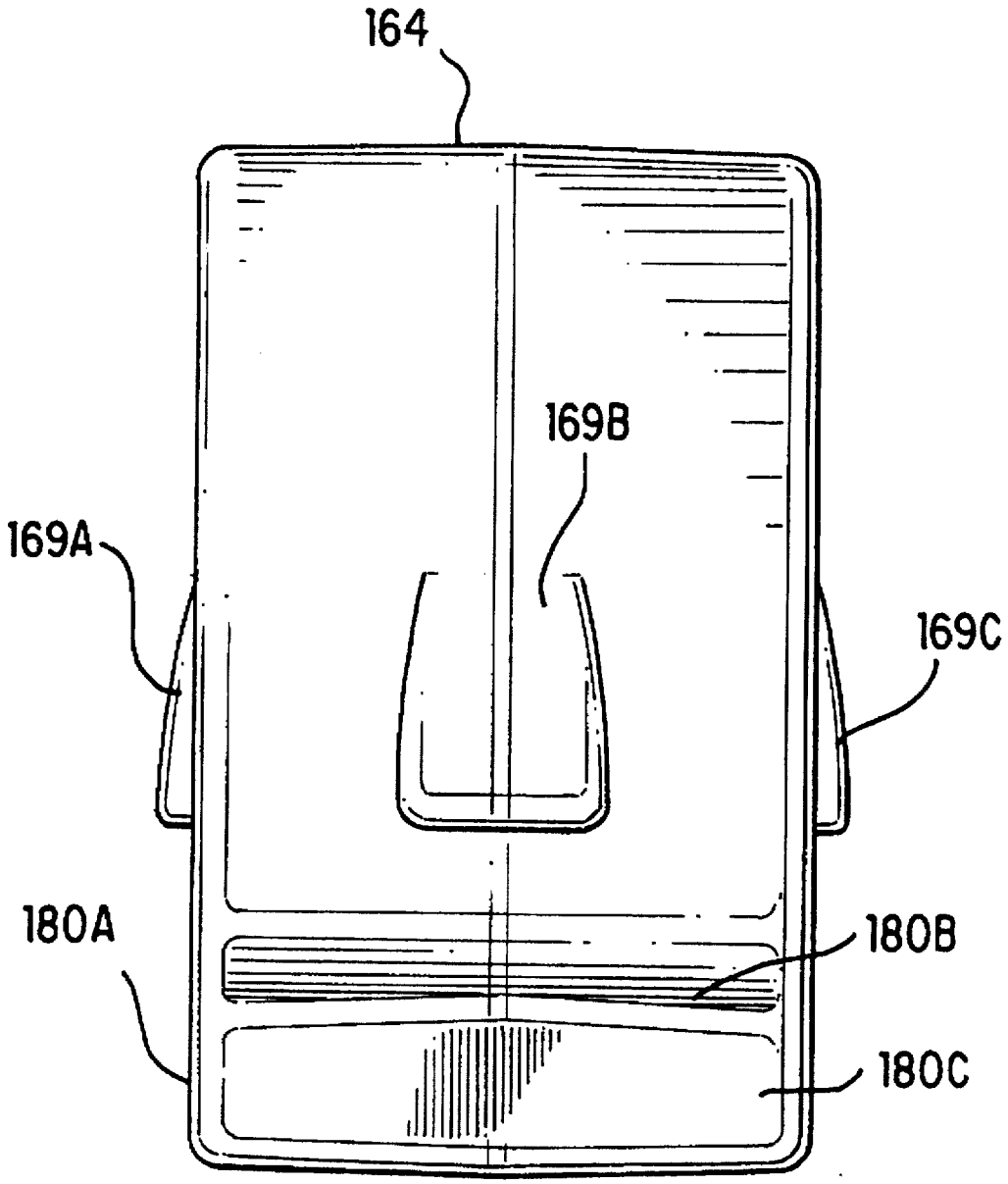

As illustrated in FIGS. 4A–C, the hoop support recess 166 includes a left recess portion 167, a right recess portion 168, and a detent ridge 182. The left and right recess portions 167 and 168 each include four surfaces. As shown in FIG. 4B, right recess portion 168 includes a front wall 168A, a top wall 168B, a rear wall 168C, and a bottom wall 168D. Similar surfaces are present for left recess portion 167. The detent ridge 182 includes a left face 182A, a right face 182B, a front face 182C, and a bottom face 182D. The hoop support recess 166 is provided below the carved upper end upper end 164 to support the hoop structure 300.

Again referring to FIGS. 4A–C, curved upper end 164 of the upper pole section 160 includes left, top and right detents 169B, 169A, and 169C for retaining the backboard 200 in the upright position, a front face 178, and a backboard engagement portion generally designated as 180. The backboard engagement portion 180 includes a top surface 180B, and left and right surfaces 180C and 180D. The curved upper end also has a sloped stop face 181 which provides an abutment surface to prevent the backboard from moving forward past the upright position.

Hoop Structure

As shown in FIG. 1A, the hoop structure 300 comprises a circular hoop 310 and a neck flange 320. Neck flange 320 includes left and right shoulders 320A and 320B, respectively, and a pair of opposed left and right recess engaging lugs 322 and 324 for cooperatively engaging the hoop support recess 166 in the upper post 160. The recess engaging lugs 322 and 324 are rectangular block structures which facilitate a snap fit with the hoop support recess 166. A notch 326 is provided between the recess engaging lugs 322 and 324. As shown in greater detail in FIGS. 6A–6D, the left and right recess engaging lugs comprise five surfaces and a detent post on the outside edge thereof. As shown for example in FIGS. 6A–C, the right recess engaging lug 324 comprises a front surface 324A, a top surface 324B, a rear surface 324C, a bottom surface 324D, and an inside surface 324E. A right detent post 332 is provided on the outside edge of the recess engaging lug 324. Similar surfaces (not numbered) are provided for left detent lug 322.

Figure 6A:
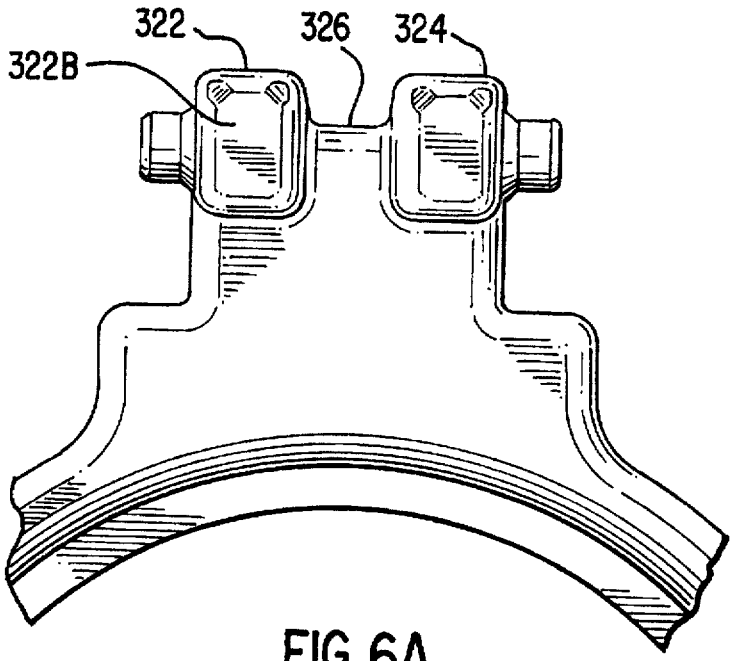
FIGS. 6A–D are partial top, side, rear, and bottom views, respectively, of the hoop of the basketball goal of FIG. 1A
Figure 6B:
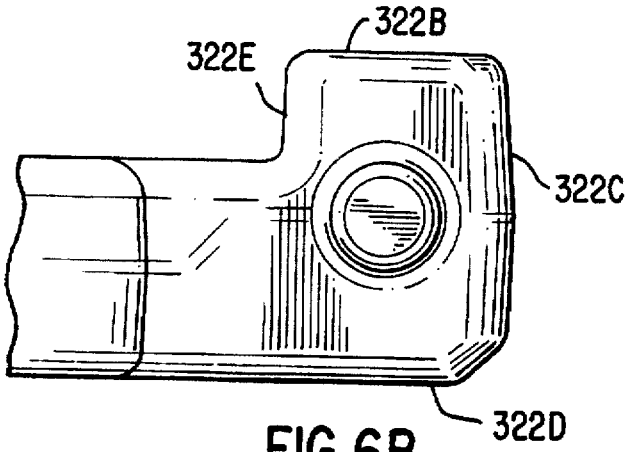
Figure 6C:
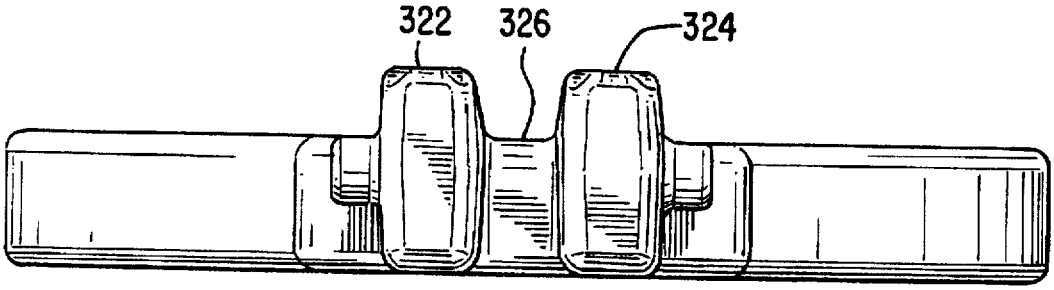
Figure 6D:
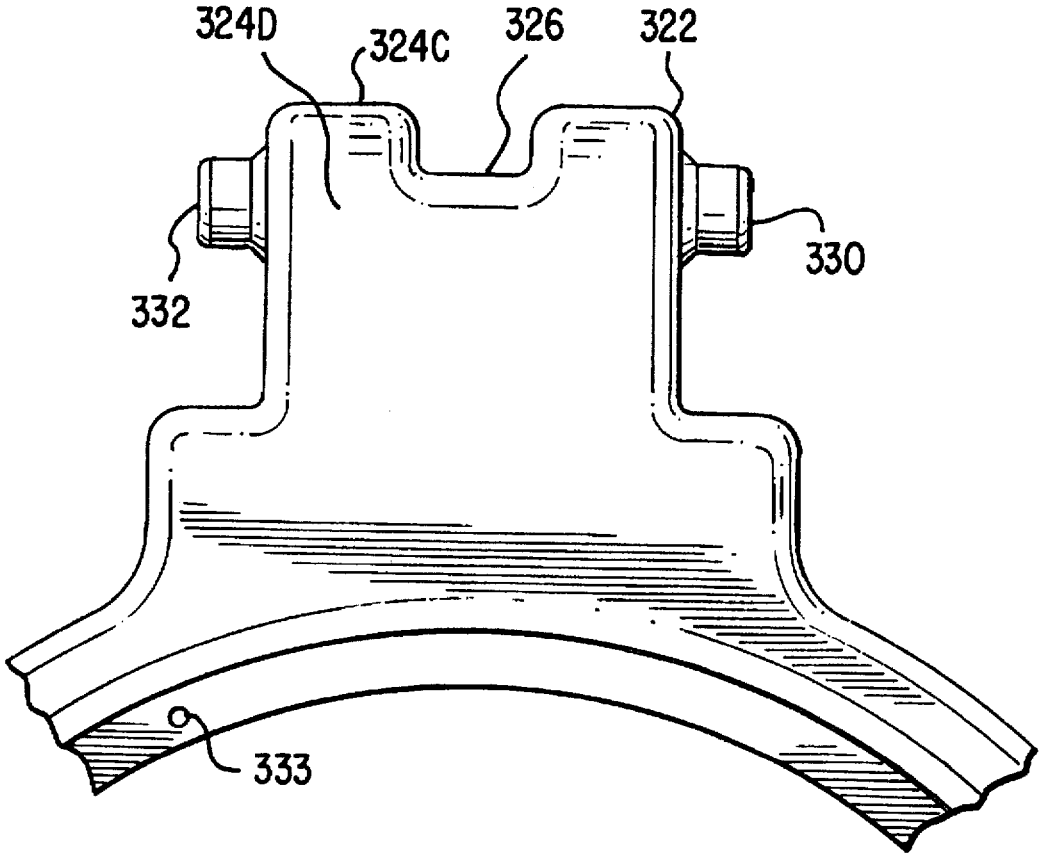
Figure 6E:
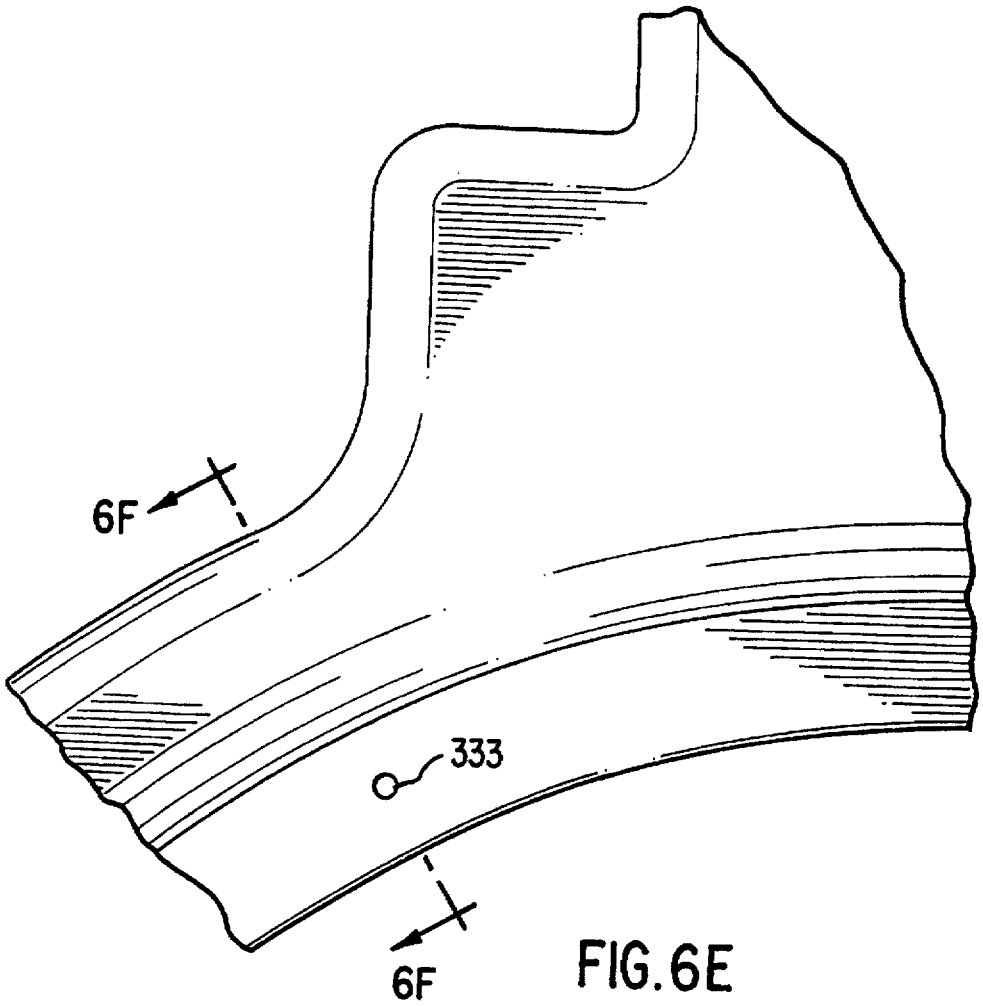
FIG. 6E is a top detail view of a mounting hole on the circular flange of the hoop.
Figure 6F:
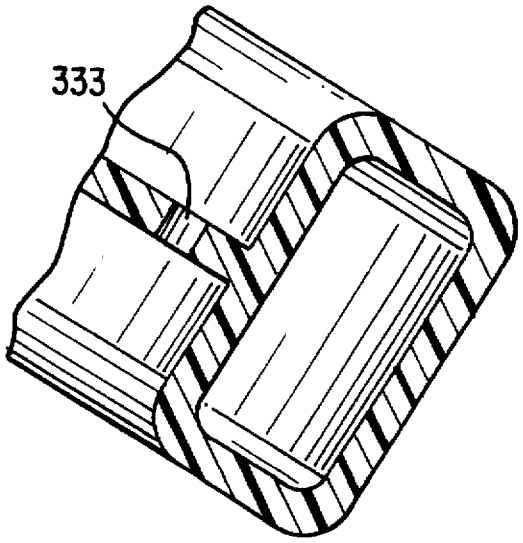
FIG. 6F is a cross-sectional view along line 6F—6F of FIG. 6E.

As shown in FIGS. 6A and 6D, hoop 310 is provided with an inner face 312 which includes a horizontal circular flange 314. Four mounting holes, such as mounting hole 333 illustrated in FIGS. 6D, 6E and 6F, are provided at 90° intervals along the horizontal circular flange 314 for mounting the circular net retention hoop 340.

Backboard

Figure 5A:
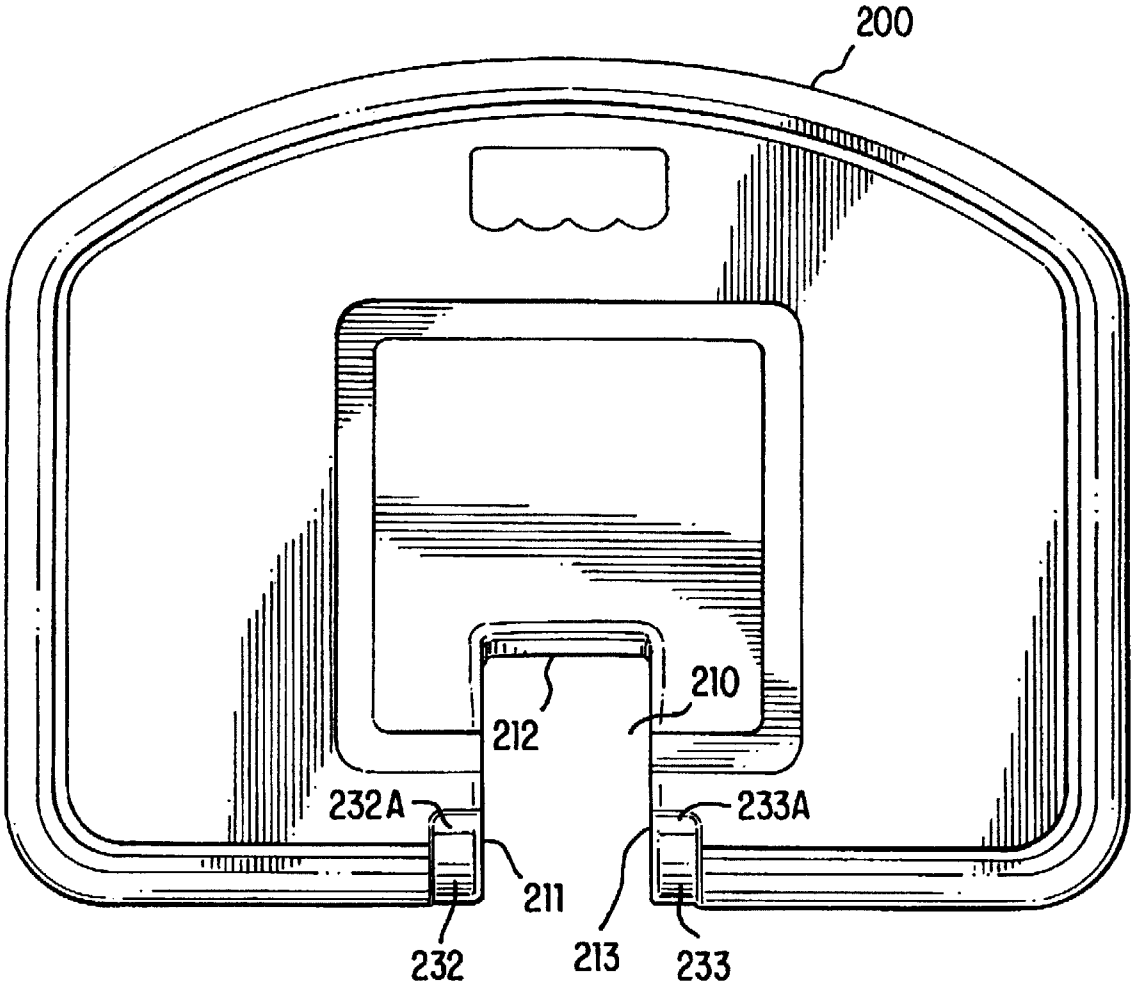
FIGS. 5A and 5B are front and rear views of the backboard of the basketball goal of FIG. 1A.
Figure 5B:
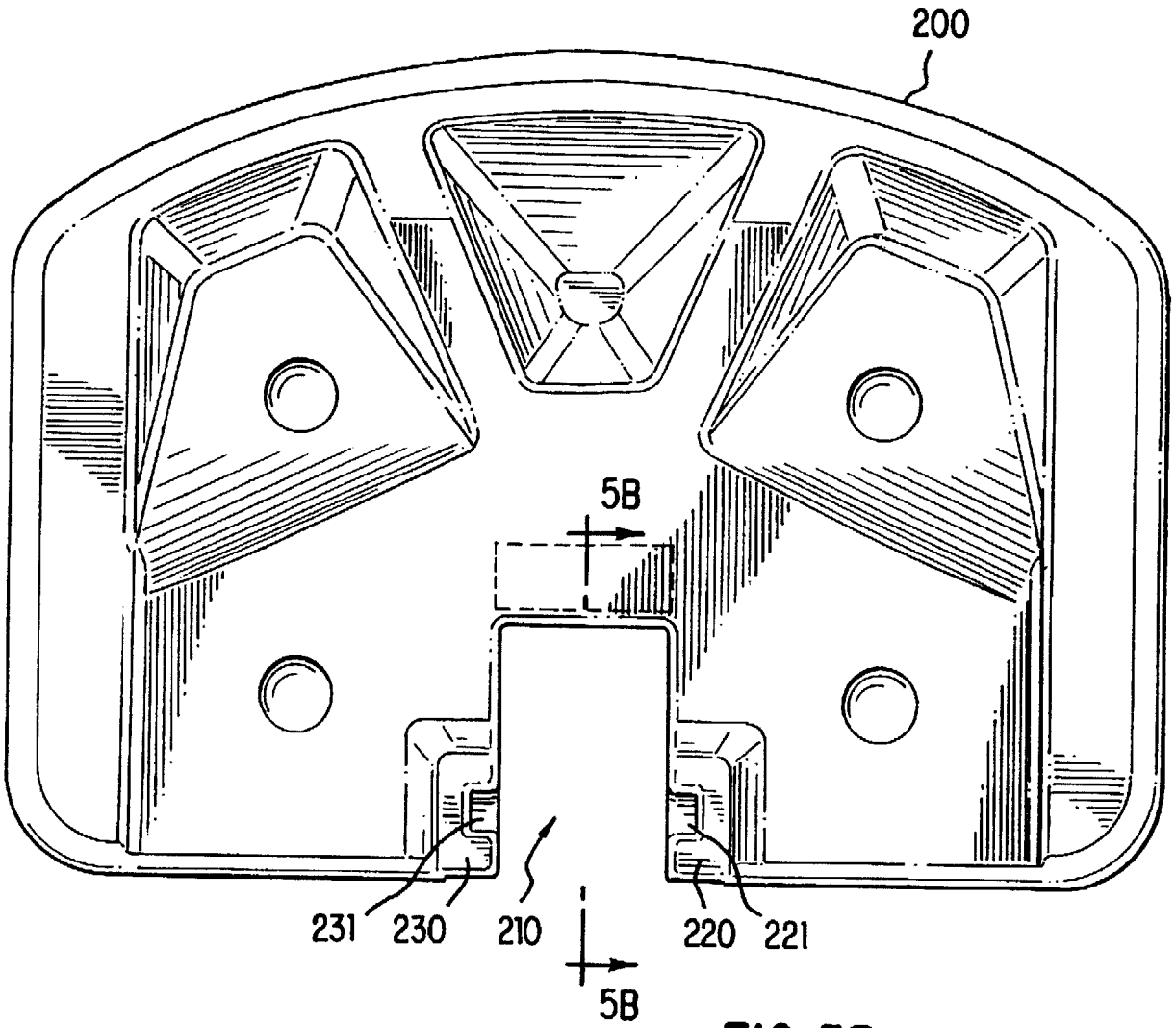

Referring again to FIG. 1A, the backboard 200 is provided with a notch 210 to engage the backboard engagement portion 180 of the upper pole section 160. As shown in greater detail in FIGS. 5A, 5B, 5C, and 5D, the notch 210 has a left side 211, a top side 212, and a right side 213. The top side 212 includes front portion, a sloped middle portion 212B, and a rear portion 212C, as shown particularly in FIGS. 5C and 5D. The back face 250 of the backboard 200 has a left journal boss 220 with a left journal indentation 221 and a right journal boss 230 with a right journal indentation 231. In the assembly process, the journal indentations 221 and 231 are seated on the left and right detent posts 330 and 332 on the sides recess engagement lugs 322 and 324. As shown more particularly in FIGS. 5A and 5C, the front face 240 of the backboard 200 is provide with a left clearance bevel 232 and a left upper stop face 232A, as well as a right clearance bevel 233 and a right upper stop face 233A. The clearance bevels allow the backboard 200 to be pivoted into the upright position with adequate clearance of the left and right shoulders 320A and 320B of the neck flange 320.

Net Retention Hoop

The circular net retention hoop 340 depicted in FIG. 1A is assembled from two identical half-circular flanges 342 and 342A. The structure of each may be illustrated with a single example. As shown in FIGS. 7A–D, each half-circular flange 342 and 342A has both a male connector end 343 and a female connector end 344. After the net loops are threaded onto both of the half-circular flanges, the male connector ends of the flanges are inserted into the female connector ends of the other flange. As shown in FIGS. 7A–D, the male connector end 343 comprises an inner side wall 343A, an outer side wall 343B, and a central slot 343E to provide a flexing action to the inner and outer side walls. Inner and outer projections 343C and 343D are also provided. The female connector has a receiving passage for the male connector end 343 of the other half-circular flange, and an inner shoulder 344B and an outer shoulder 344C to allow inner and outer projections 343C and 343D to snap into place and secure the two half-circular flanges together to form the circular net retention hoop 340.

Figure 7A:
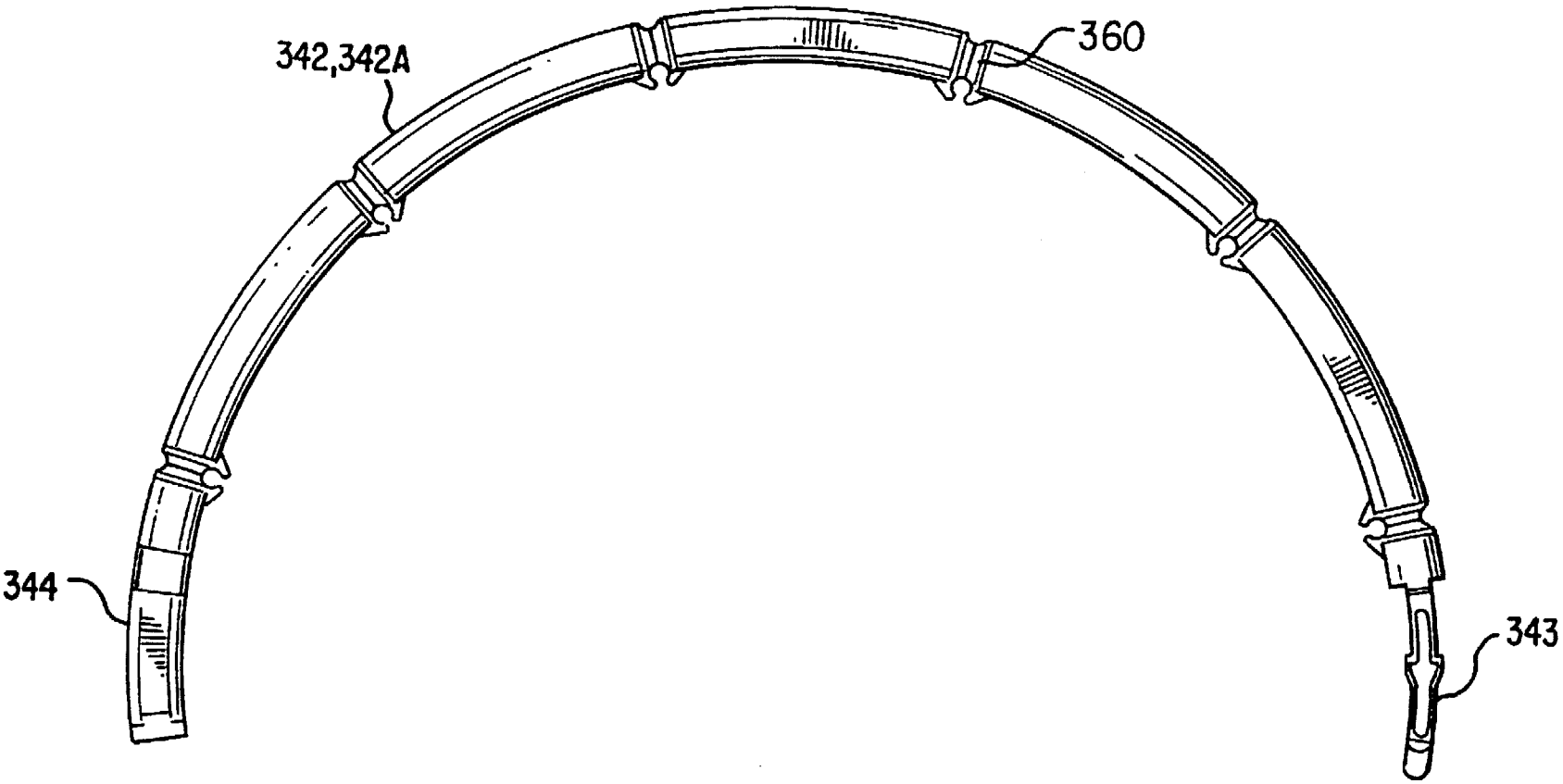
FIGS. 7A and 7B are top and bottom views, respectively, of one of the half-circular flanges of the circular net retention hoop of the basketball goal of FIG. 1A.
Figure 7B:
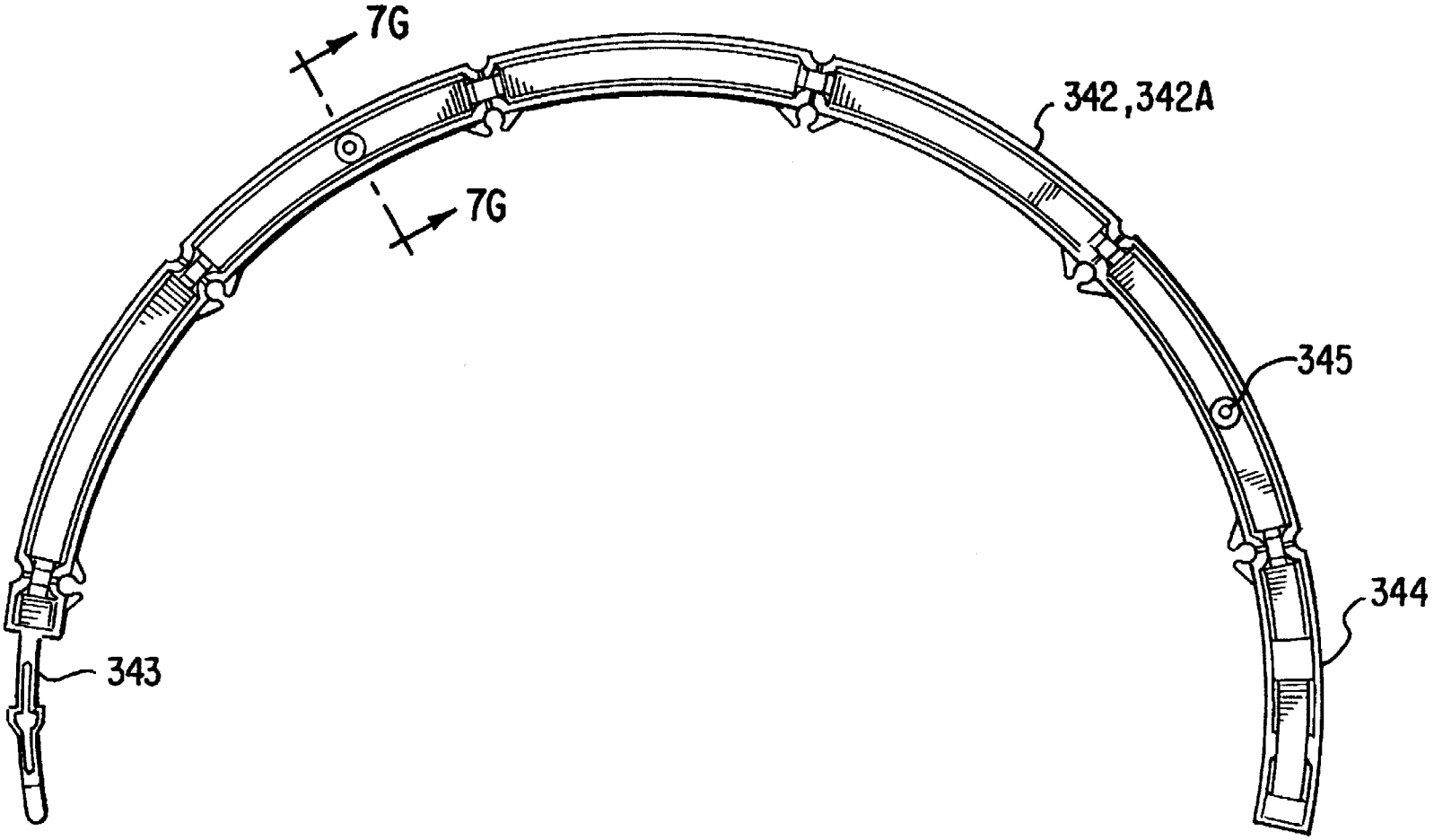
Figure 7E:
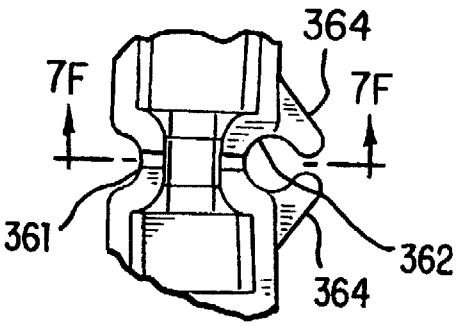
FIG. 7E is a top detail view of one of the net loop retainers of one of the half-circular flanges.
Figure 7D:
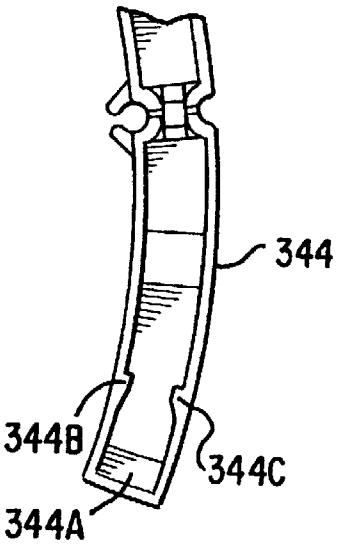
FIG. 7D is a bottom detail view of the female connector end of one of the half-circular flanges
Figure 7C:
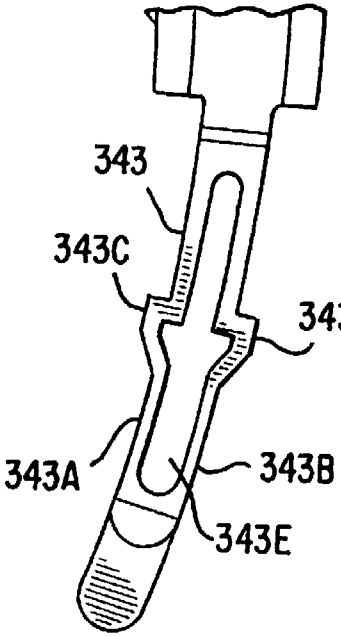
FIG. 7C is a detail view of the male connector end of one of the half-circular flanges
Figure 7F:
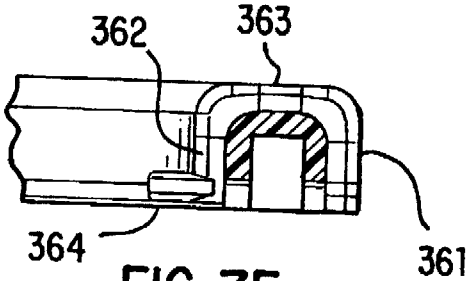
FIG. 7F is a cross-sectional view taken along line 7F—7F of FIG. 7E.
Figure 7G:
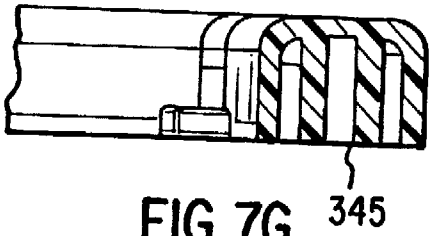
FIG. 7G is a cross-sectional detail view of one of the mounting posts of the circular net retention hoop, taken along line 7G—7G of FIG. 7B.

Referring to FIGS. 7A and 7B, the net retention hoop 340 has a plurality of net loop retainers 360. As shown in greater detail in FIGS. 7E and 7F, the net loop retainers 360 comprise a notch for retaining the net loops, including an outer notch portion 361, an inner notch portion 362, and an upper notch portion 363. Opposed retaining tabs 364 are also provided on the inner side of each net loop retainer to securely hold the net loops in place. As is clear from FIGS. 7B and 7F, the bottom surface of the circular net retention hoop is provided with four mounting posts 345, which are spaced 90° apart. To mount the circular net retention hoop 340 to the circular flange 314, the mounting posts 345 are aligned with the mounting holes 333 on the circular flange of the hoop 310. As FIG. 7G illustrates, each mounting post can be secured by, for example, self-threading screws to securely fasten the net retention hoop 340 to the circular flange 314. Although the assembly of the circular net retention hoop 340 is preferably performed during manufacturing, it may alternatively be performed by the user.

Basketball Goal Assembly

Poles in Base

Figure 8C:
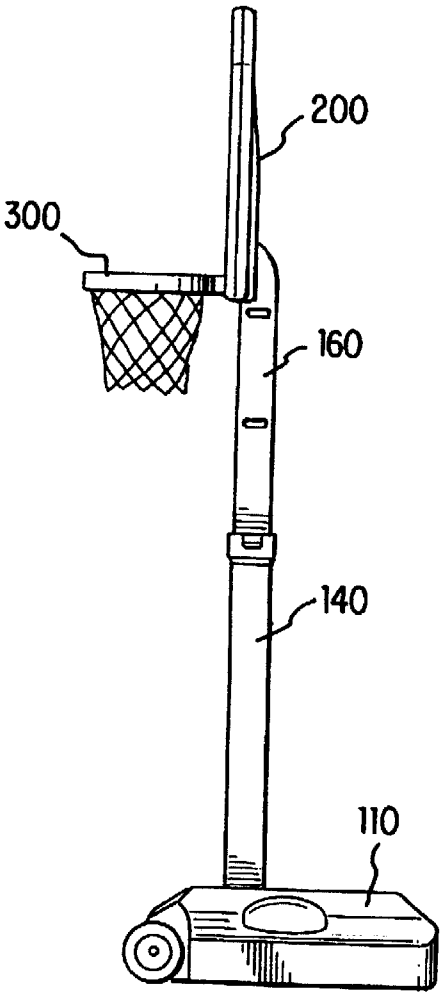
FIG. 8A–C are side views of the basketball goal of FIG. 1A showing the non-telescoping mode of operation, and in lower and upper heights of the telescoping mode of operation, respectively.
Figure 8B:
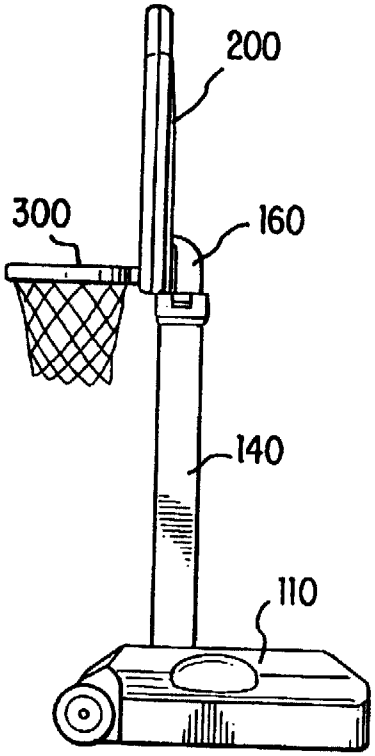
Figure 8A:
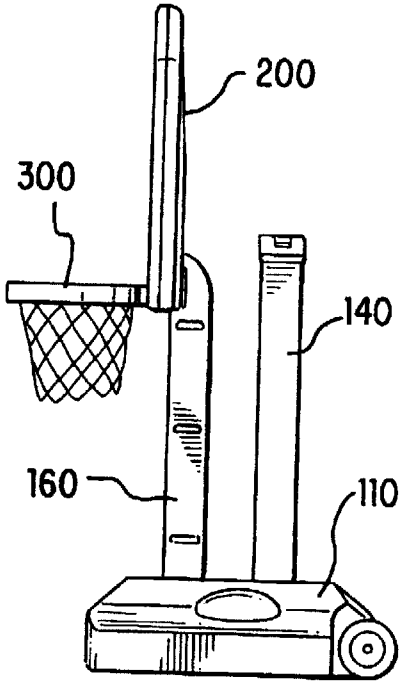

As shown in FIGS. 1A, and 8AC, the basketball system 50 can be operated in either a telescoping or non-telescoping mode. In both modes, the lower end 148 of lower pole section 140 is inserted into the lower pole socket 130 until peripheral shoulder 152 abuts the contoured upper surface 112 of the base. Accordingly, this operation need be performed only once by the user. When this is done, front wall 148A of the lower pole section 140, including front detent 151A, engages the front wall 130A and the front detent recess 130E of the lower pole socket 130 of the base 111. Similarly, rear wall 148C and rear detent 151B of the lower pole section 140 engage the rear wall 130C and the rear detent recess 130F of the lower pole socket 130. The engagement of the detents, in addition to the engagement of the tapering upper and lower portions 130H and 130I of the pole socket with the similarly tapered upper and lower portions 148E and 148F of the lower end 148 of the lower pole section 140, combine to provide a strong, permanent seating of the lower pole 140 in the lower pole socket 130. Proper orientation for the lower pole 140 in the lower socket 130 is base 111 is ensured by the vertical keyhole slot 153 and the matching key 153 on the side of the lower pole 140.

The basketball goal may be operated in non-telescoping mode by inserting the lower end 172 of the upper pole section 160 into the upper pole socket 132 of the base 111. A tight fit between the tapering upper and lower portions 173A and 173B of the lower end with the similarly tapered upper and lower portions 132A and 132B of the upper pole socket 132 is provided by the front and rear wedges 174A and 174B on the lower end 172, which engage the lower portion 132B of the upper pole socket 132.

The basketball goal may be operated in telescoping mode by inserting the upper pole section 160 through the center opening 188 of the latch assembly 184 and sliding the upper pole section downwardly until one of the molded detents 183 is aligned with the pivot latch 190. The goal may be maintained at the desired height by engaging the pivot latch 190 into the molded detent 183.

Hoop and Upper Pole

Figure 9A:
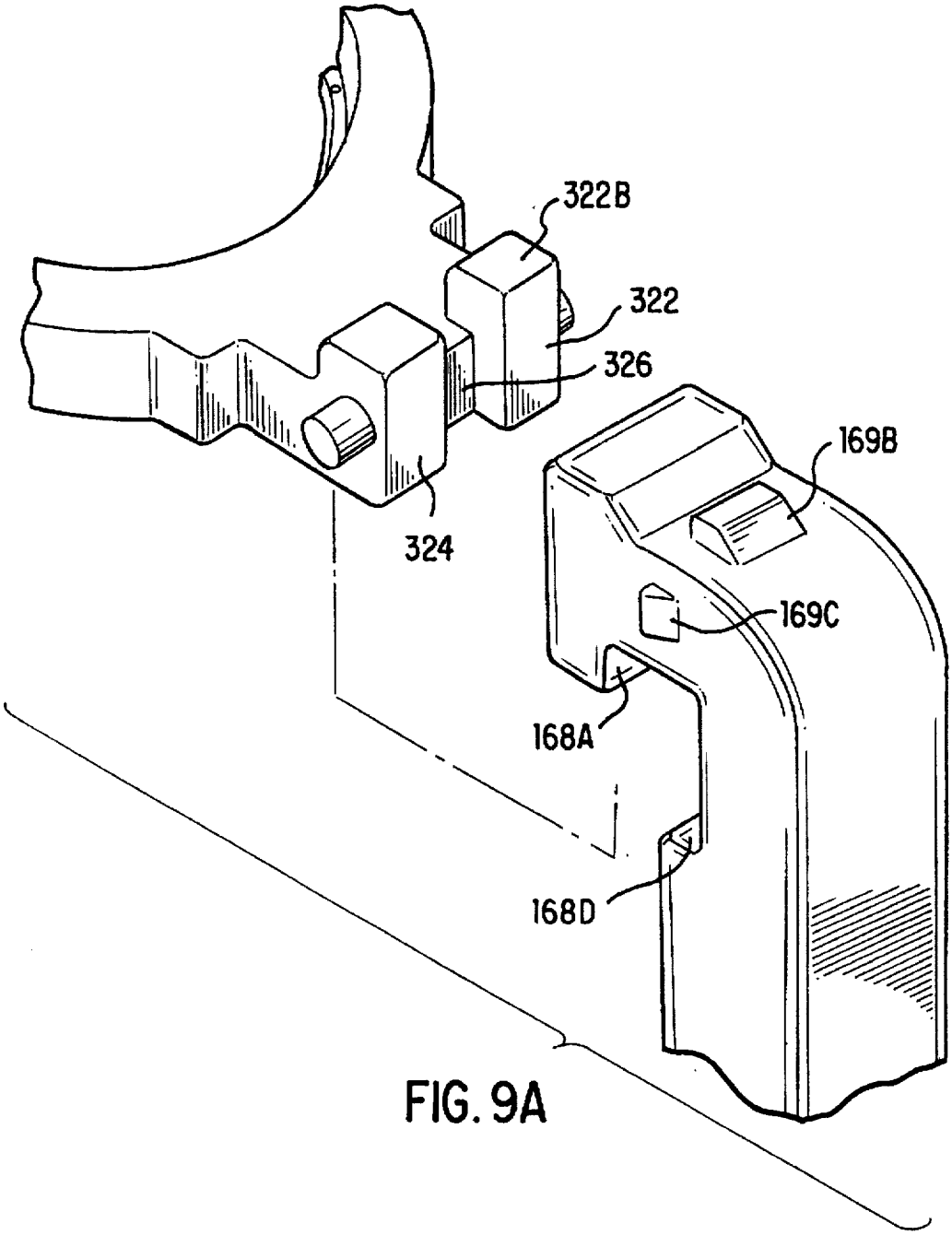
FIG. 9A is a partial perspective view illustrating the assembly of the neck flange and the upper end of the upper pole section.
Figure 9B:
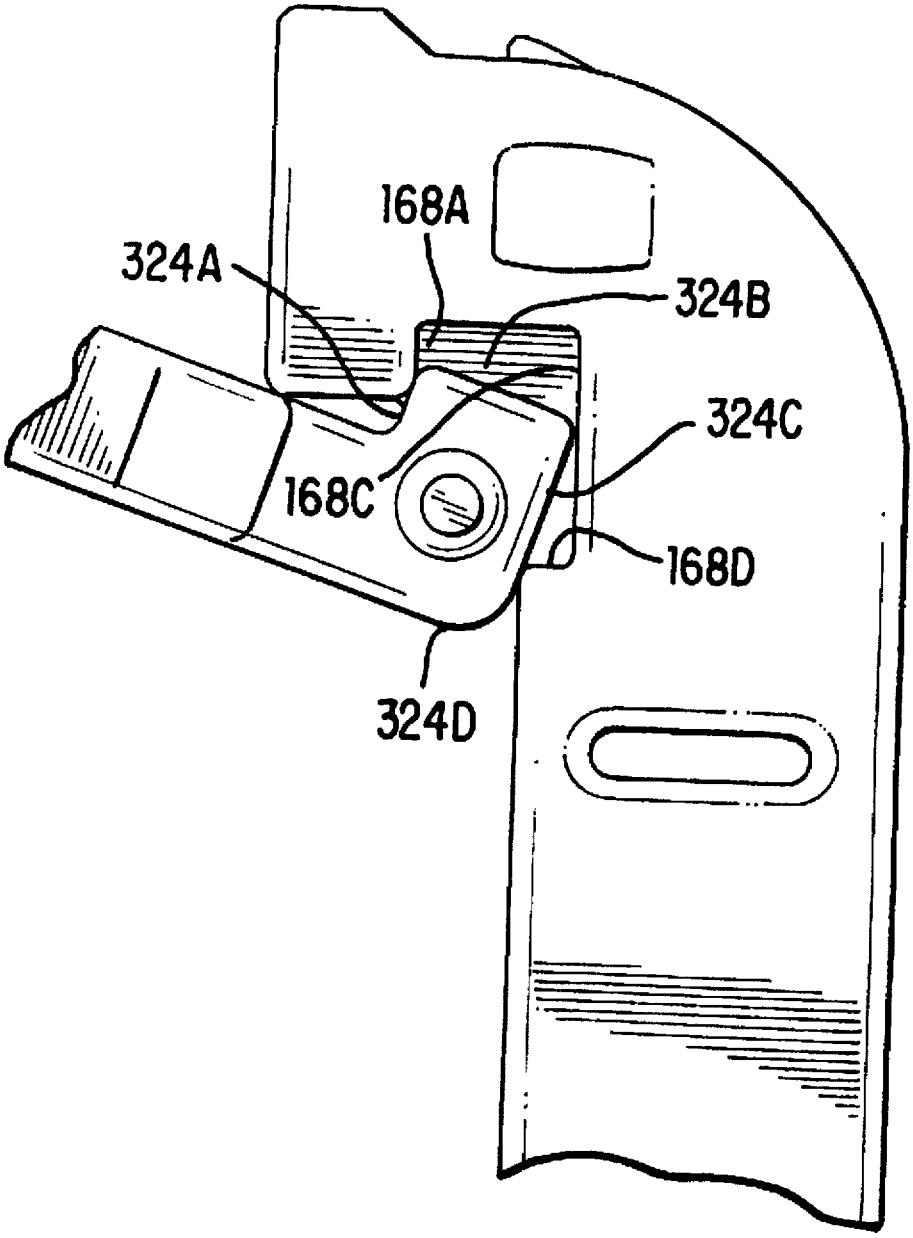
FIG. 9B is a partial side view of the assembly of the neck flange and the upper end of the upper pole section.

Referring to FIGS. 9A and 9B, the hoop structure 300 is attached to the upper support pole 160 by engaging the hoop support lugs 322 and 324 into the hoop support recess 166. As shown in FIG. 9B, the hoop support lugs 322 and 324 can be snap-fitted into the hoop support recess 166. This engagement rigidly prevents both vertical and lateral movement of the hoop. Vertical movement is inhibited by numerous interconnections. The front, top, rear and bottom surfaces 324A, 324B, 324C, and 324D, respectively, of the right recess engaging lug 324 engage the front wall 168A, the top wall 168B, the rear wall 168C, and the bottom wall 168D of the right recess portion 168 of the hoop support recess 166. Additionally, the inside surface 324E of the right recess engaging lug 324 engages the right face 182B of the detent ridge 182. The front, top, rear and bottom surfaces of the left recess engaging lug 322 contact like surfaces in the left recess portion 167 of the recess 166. Finally, the bottom face 182D and the front face 182C of the detent ridge 182 contact the surfaces of the notch 326 between the left and right recess engaging lugs 322 and 324.

Backboard and Hoop/Post

Figure 9C:
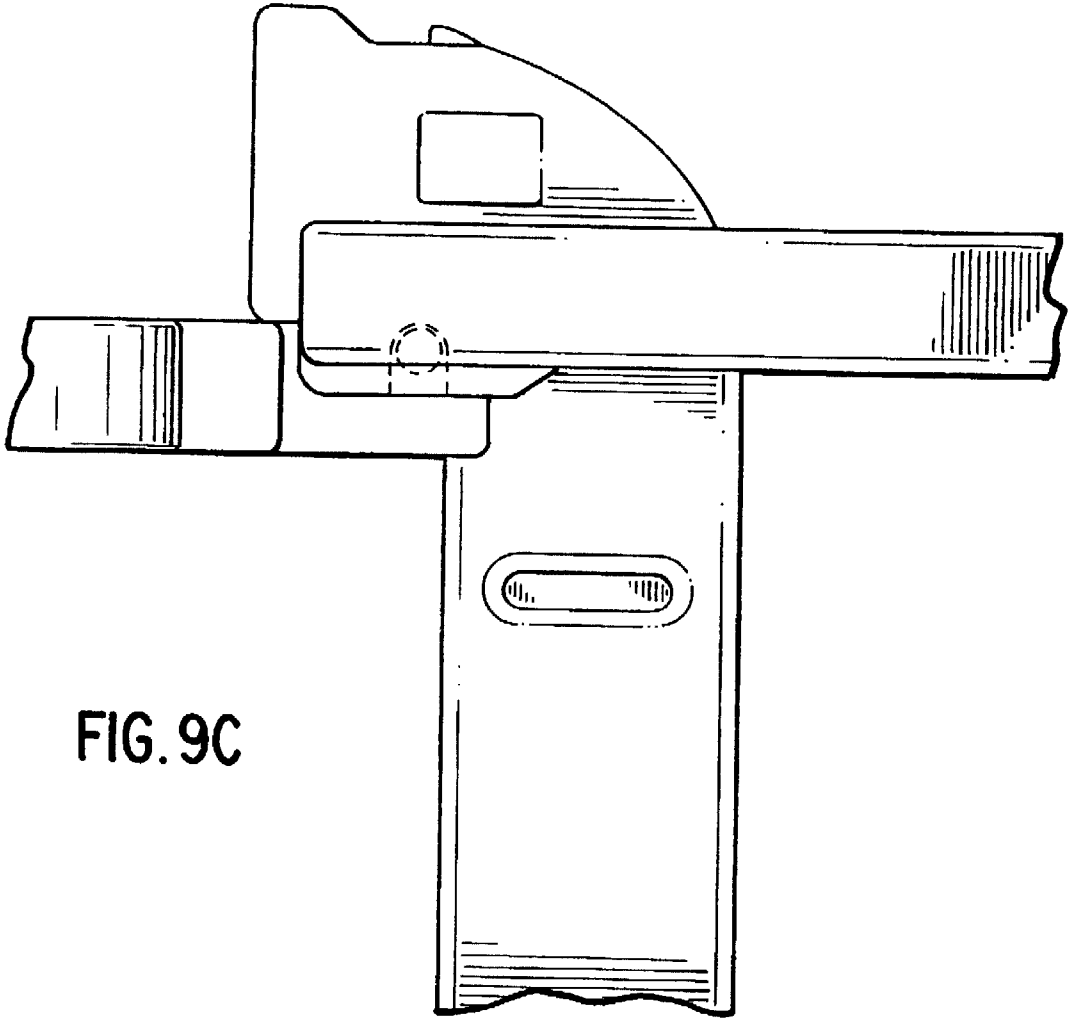
FIG. 9C is a partial side view of the assembly of the backboard onto the hoop structure and upper pole section.
Figure 9D:
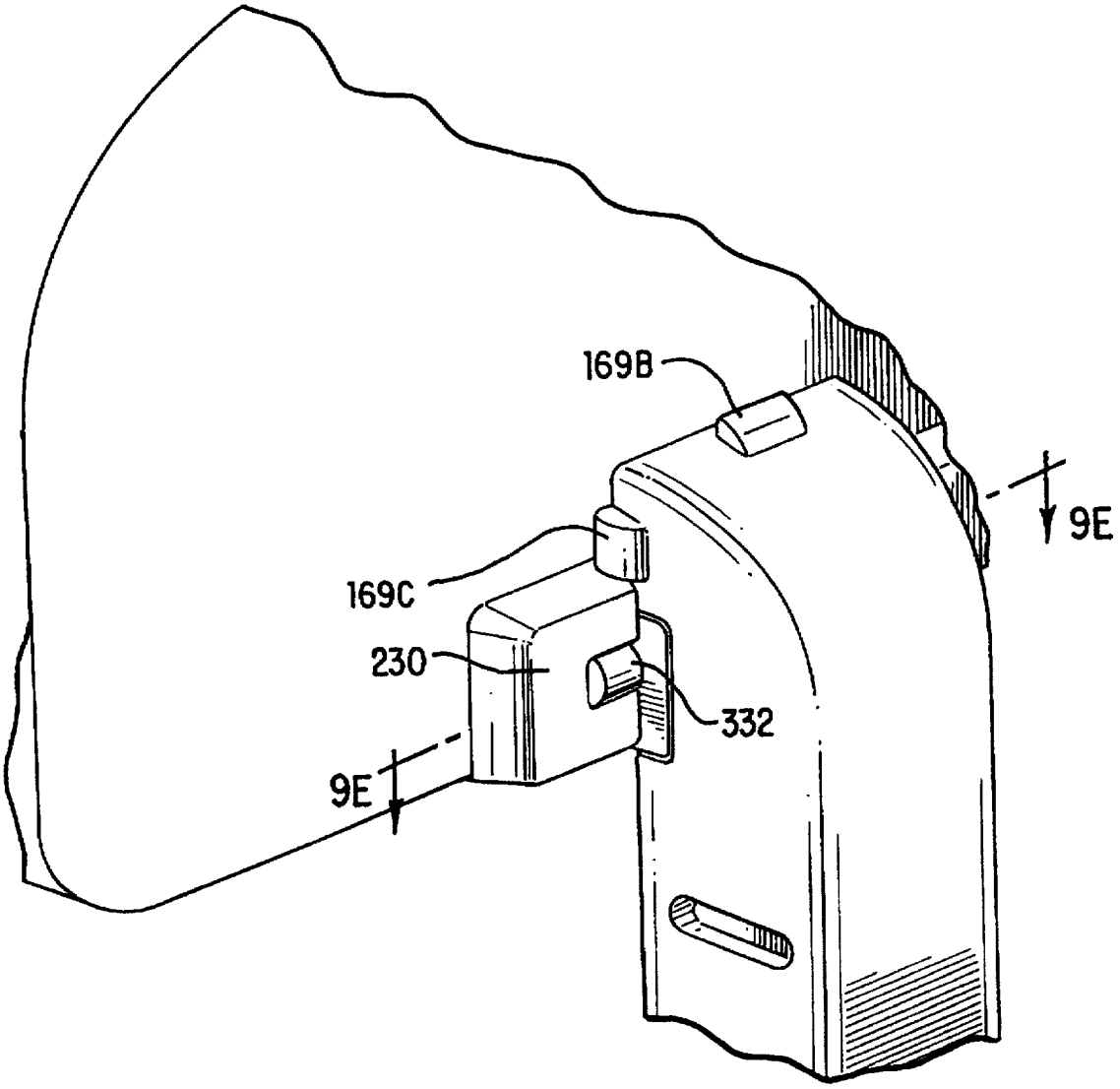
FIG. 9D is a partial rear perspective of the assembled hoop system.

After the hoop structure 300 is connected to the upper support post, the backboard may be easily attached to the hoop structure 300. Referring now to FIGS. 9C and 9D, the detent posts 330 and 332 on the outside edges of the hoop support lugs 322 and 324 provide a pivot axis for the backboard. The backboard 200 is positioned horizontally (or at a slight angle thereto), front face 240 facing up, such that the notch 210 straddles the upper support pole 160 and the journaled indentations 221 and 231 seat over and engage the detent buttons 330 and 332 respectively. The backboard may be simply and easily attached by pivoting the backboard upwards into place the vertical position.

As the backboard 200 is pivoted forward, the notch 210 passes over backboard retention lugs 169A, 169B, and 169C on the upper end 164 of upper support pole 160, compressing the lugs in the process. As the backboard 200 is pivoted into the fully upright position of FIG. 9D, the backboard retention lugs 169A, 169B, and 169C spring back into position against the back face 250 to support the backboard 200 in the upright position.

Figure 5C:
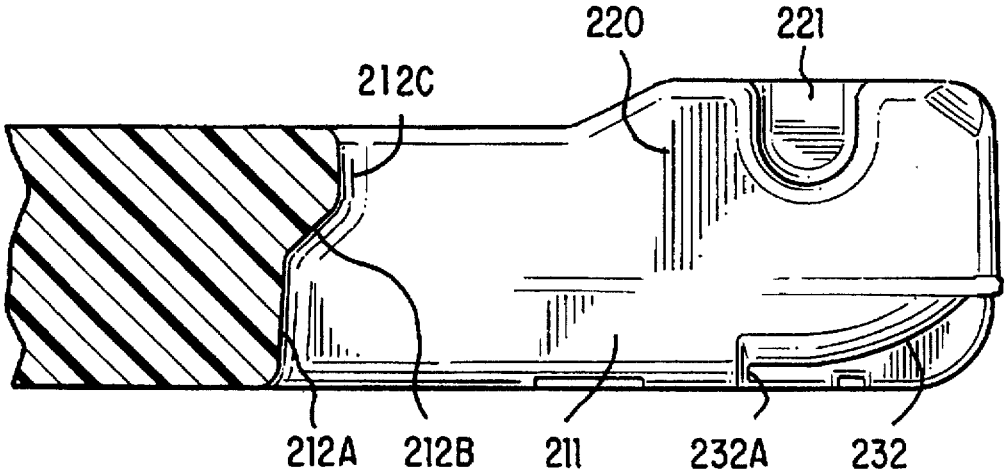
FIG. 5C is partial cross-sectional view of the backboard, taken along line 5C—5C of FIG. 5A.
Figure 5D:
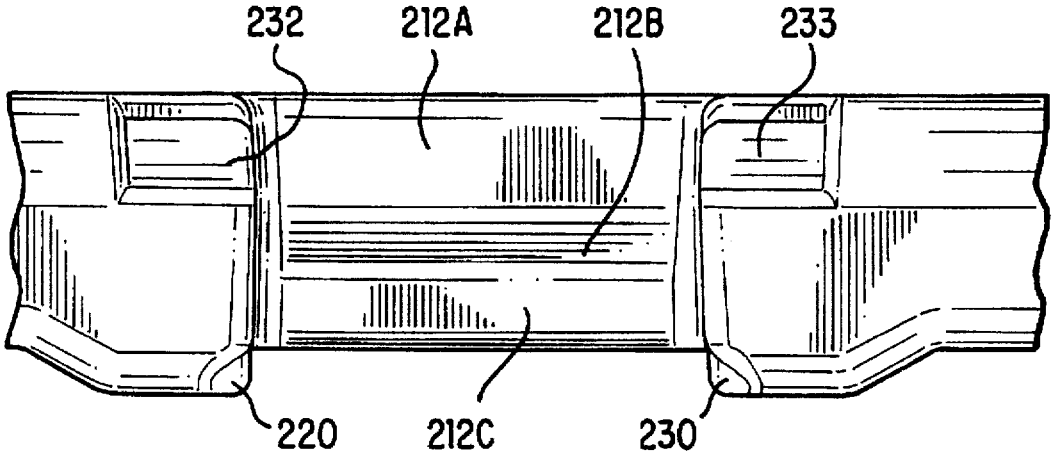
FIG. 5D is a partial bottom view of the backboard.

As shown in FIGS. 4B, 5C, and 5D, when the backboard is pivoted forward the front face 240 will stop flush with the front face 178 of the curved upper end 164 of the upper pole section 160. Further forward motion of the backboard will be prevented by the contact between the upper middle portion of the notch 210 with the sloped stop face 181. Lateral motion will be further inhibited by contact between the left side 211 and the right side 213 of the notch 210 with the left surface 180C and the right surface 180D of the backboard engagement portion of the curved upper surface 164 of the upper pole section 160. Finally, additional resistance to motion will be provided by the contact between the upper stop faces 232A of the left clearance bevel 232 and 233A of the right clearance bevel 233 and the left and right shoulders 320A and 320B of the neck flange 320 of the hoop structure 300.

Figure 9E:
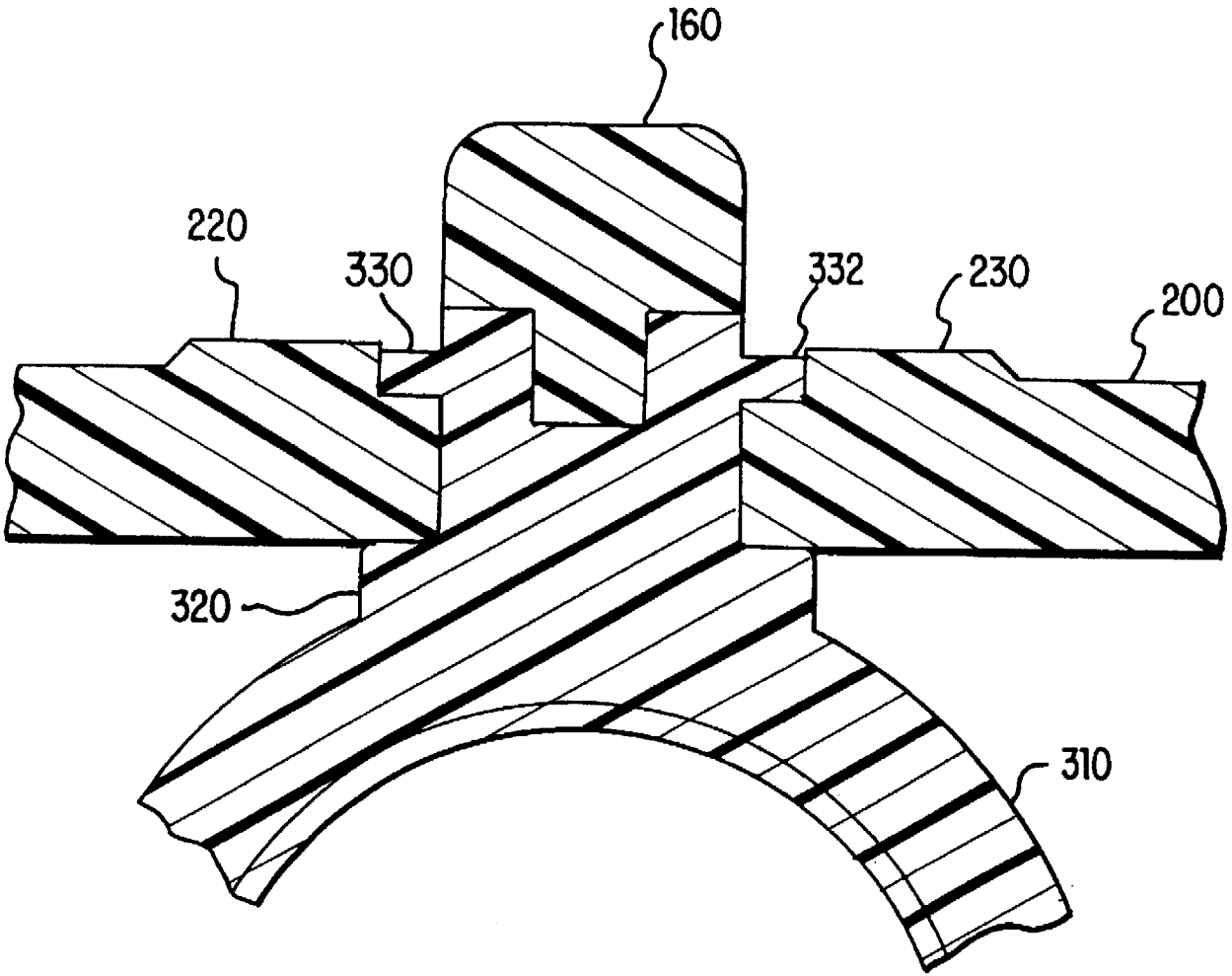
FIG. 9E is a cross-sectional view of the assembled hoop system, taken along line 9E—9E of FIG. 9D.

FIG. 9E shows a cross-sectional view of the interconnections between the upper pole section 160, the neck flange 320, and the backboard 200.

When the backboard 200 is secured to the hoop structure 200 and the upper pole section 160, the net may easily be attached by the procedure outlined earlier in the discussion of the circular net retention hoop 340. After the upper loops of the net are threaded onto the two of two half-circular flanges 342 and 342A onto which the upper loops of the net 400 are threaded, the two half-circular flanges 342 and 344 are snap-fit together to form the circular net retention hoop 340. The loops of the net are placed in the net loop retainers 360, and the circular net retention hoop is aligned with the mounting holes 333 in the circular flange 314 and secured to the circular flange 314 by self-threading screws. The net loops are thus trapped between the net retention hoop and the upper surface of circular flange 314 and cannot by pulled free.

As is clear from the foregoing description, the basketball system of the present invention may be readily assembled with simple tools. First, the lower pole section 140 is inserted into the base 110, which is filled with ballast. The hoop structure 300 is snapped into position in the hoop support recess 166 of the upper pole section 160, and the backboard 200 is pivoted into position from behind the hoop structure and the upper pole section 160. The upper pole section 160 may then be either inserted the base 110 or used telescopically in conjunction with the lower pole section 140. Finally, the net 400 may be suitably threaded onto the half-circular retention flanges 342 and 32A4 which, after being snap-fit together, are suitably affixed to the circular flange 314 on the inner face 312 of the hoop 310.

In the illustrated embodiment, the components are molded of plastic materials, as is conventional for such products. Although disclosed as being formed in two identical semi-circular sections, the net retention hoop could be formed of any number of sections of any angular extent that collectively form a 360° hoop. The hoop also need not be assembled into a continuous hoop before attachment to the circular flange but instead can be formed of segments threaded through one or more net loops each and attached to circular flange. Finally, it will be readily appreciated that many equivalent snap-fit geometries for particular parts may be employed without departing from the scope of the invention.

What is claimed is:

1. A basketball goal comprising:

a support post having a shaft, an upper end having a backboard retaining lug, and a hoop support recess below said upper end;

a hoop with a flange engageable with said hoop support recess, said flange having a pair of backboard pivot posts disposed on opposite surface hereof to provide a horizontal pivot axis spaced from said hoop; and a backboard having a back surface engageable with said retaining lug and a lower edge with a notch for engaging said upper end of said support post, said notch further comprising a pair of pivot recesses for engaging said backboard pivot posts, whereby said backboard and said hoop can be fixed to said post by engaging said hoop support recess with said flange, engaging said pivot posts with said pivot recesses, and engaging said upper end of said support post and said backboard retaining lug with said backboard.

2. The toy basketball goal of claim 1, wherein said hoop support recess further comprises a detent ridge for engaging said hoop flange.

3. The toy basketball goal of claim 2, wherein said hoop flange further comprises a pair of opposed recess engaging lugs for cooperatively engaging said hoop support recess, said recess engaging lugs forming a notch therebetween for cooperatively engaging said detent ridge.

4. The toy basketball goal of claim 1 wherein said support post further comprises a curved elbow comprising a 90° bend in said support post, said curved elbow comprising the upper end of said support post.

5. The toy basketball goal of claim 4, wherein said hoop support recess is located in the bend of said elbow.

6. A basketball goal comprising, a support post having an upper end having a backboard retaining lug and a backboard support surface, and a support recess below said upper end having first and second contoured surfaces with a detent ridge therebetween;

a hoop with a flange, said flange having opposing first and second recess engaging lugs, each said lug having a backboard pivot post on an outer edge thereof, and a peripheral surface for engaging said first and second contoured surfaces of said support recess, said first and second recess engaging lugs further comprising a notch therebetween for cooperatively engaging said detent ridge; and a backboard having a back surface for engaging said backboard retaining lug and a lower edge with a support notch having an inner surface for engaging said backboard support surface, said support notch further comprising opposing pivot recesses for engaging said backboard pivot posts.

7. The toy basketball goal of claim 6 wherein said support post further comprises a curved elbow comprising a 90° bend in said support post, said elbow comprising the upper end of said support post.

8. The toy basketball goal of claim 7, wherein said hoop support recess is located in the bend of said elbow.

9. A height adjustable support system for a basketball goal, comprising, a base having an upper surface, a first support socket disposed in said upper surface, and a lower support post projecting upwardly from said upper surface and having a shaft with a hollow bore;

a goal support post having a shaft with a lower end engageable with said first support socket and slidably receivable in said bore of said lower support post and an upper end engageable with the basketball goal whereby said upper end of said backboard support post is disposed at a first height when said goal support post is engaged with said first support socket and is disposed at a second height, greater than said first height, when said backboard support post is disposed in said lower support post.

10. The basketball goal of claim 9, wherein said lower support post further comprises means for adjustably retaining said backboard support post at a plurality of positions within said hollow bore.

11. A basketball goal comprising;

a circular hoop comprising a short cylinder having upper and lower ends and an interior flange in a plane perpendicular to said cylinder and between said upper and lower ends, and a circular net retention hoop onto which the upper loops of a basketball net are threadedly engaged, said net retention hoop fixedly engaging said interior flange to retain said net on said circular hoop.

* * * * *